US006904835B2

(12) United States Patent
Dugan et al.

(10) Patent No.: US 6,904,835 B2
(45) **Date of Patent: *Jun. 14, 2005**

(54) MECHANICAL COUPLER

(75) Inventors: Larry Dugan, Boulder, CO (US); Steven X. Johnson, Golden, CO (US)

(73) Assignee: DJ Technologies, Inc., Golden, CO (US)

( * ) Notice: Subject to any disclaimer, the term of this patent is extended or adjusted under 35 U.S.C. 154(b) by 22 days.

This patent is subject to a terminal disclaimer.

(21) Appl. No.: 10/670,175

(22) Filed: Sep. 23, 2003

(65) Prior Publication Data

US 2004/0112186 A1 Jun. 17, 2004

Related U.S. Application Data

(63) Continuation-in-part of application No. 10/189,968, filed on Jul. 3, 2002, now Pat. No. 6,675,679.
(60) Provisional application No. 60/304,944, filed on Jul. 12, 2001.

(51) Int. Cl.[7] ..... B25B 23/08
(52) U.S. Cl. ..... 81/446; 81/442; 81/443
(58) Field of Search ..... 81/446, 442, 443

(56) References Cited

U.S. PATENT DOCUMENTS

| | | | | | |
|---|---|---|---|---|---|
| 1,672,053 | A | | 6/1928 | Brown | |
| 2,455,005 | A | | 11/1948 | Hall | |
| 2,715,346 | A | | 8/1955 | Thomas | |
| 3,296,900 | A | * | 1/1967 | Behnke | 81/448 |
| 3,847,040 | A | | 11/1974 | Buffkin | |
| 3,861,251 | A | * | 1/1975 | Streander | 81/439 |
| 3,874,714 | A | | 4/1975 | Bebinger | |
| 3,902,384 | A | | 9/1975 | Ehrier | |
| 4,144,779 | A | | 3/1979 | Honick | |
| 4,335,632 | A | * | 6/1982 | Irwin et al. | 81/446 |
| 4,338,981 | A | | 7/1982 | Frauenberger | |
| 4,377,965 | A | * | 3/1983 | Eickmann | 91/487 |
| 4,499,799 | A | * | 2/1985 | Bordages | 81/446 |
| 4,561,330 | A | | 12/1985 | Chen | |
| 5,207,131 | A | * | 5/1993 | Pool et al. | 81/443 |
| 5,257,559 | A | * | 11/1993 | Cannetti | 81/445 |
| 5,349,887 | A | | 9/1994 | Suwa | |
| 6,035,745 | A | * | 3/2000 | Kather | 81/57.13 |
| 6,212,709 | B1 | | 4/2001 | Newton | |
| 6,339,980 | B1 | | 1/2002 | Woolf | |

FOREIGN PATENT DOCUMENTS

EP 0571872 A1 12/1993

OTHER PUBLICATIONS

Pictures of Homemade Tool, 5 pages.
Ridge Tool–342 Internal Wrench.
BrassCraft T150 Internal Pipe Wrench
BrassCraft T167 Pipe Nipple Extractor.
Website: Plummingworld.com "Internal Pipe Wrench Set" 2 pages.

* cited by examiner

*Primary Examiner*—Joseph J. Hail, III
*Assistant Examiner*—Alvin J. Grant
(74) *Attorney, Agent, or Firm*—Cochran Freund & Young LLC

(57) ABSTRACT

Disclosed is a coupler that grips the internal surface of a torque receptor such as a pipe or driveshaft to be turned. When torque is applied to the coupler, one or more gripping surfaces are forced apart by a cam mechanism. The gripping surfaces tightly engage the internal surface of the pipe in response to movement of an internal cam. Torque applied to the wrench causes the pipe to turn. Because the wrench grips the internal diameter of a torque receptor, it can be used without damaging the external surface of the torque receptor, and used in very confined spaces. The gripping surfaces distribute the gripping load evenly across the pipe, which minimizes any deformation of the pipe.

26 Claims, 33 Drawing Sheets

MECHANICAL COUPLER

CROSS REFERENCE TO RELATED APPLICATIONS

This application is a continuation-in part of U.S. patent application Ser. No. 10/189,968, entitled "Internal Gripping Pipe Wrench," filed Jul. 3, 2002 now U.S. Pat. No. 6,675,679 by Larry Dugan, which was based upon and claims the benefit of U.S. Provisional Patent Application 60/304,944 entitled "Internal Gripping Pipe Wrench" filed Jul. 12, 2001, the entire contents of which is hereby incorporated by reference for all it discloses and teaches.

BACKGROUND OF THE INVENTION a. Field of the Invention

The present invention pertains generally to couplers and more particularly to couplers that engage the inner surface of a pipe, driveshaft, or similar device for transmitting torque.

b. Description of the Background

In the plumbing trade, it is common to attach pipe together using a pipe thread that is tapered, such as the standard National Pipe Thread. These thread systems are designed so that the taper of the threads force the internal and external threads to seal against each other to effect a seal for the joint. The very nature of this coupling system is such that the plumber will apply as much force as possible to ensure a tight seal for the pipes being installed. Often, a compound or putty is applied to the threads at the time of installation, but this compound can harden over time or the pipes may corrode, sometimes making removal of the pipe much more difficult than the installation.

The use of tapered threads for joining pipes is a standard method for high-pressure pipes such as steam pipes, gas pipes, and pressurized water, just as examples. The tools required for cutting pipe and cutting threads are part of every plumber's arsenal of tools, since this type of plumbing is used in almost every home, commercial building, and industrial factory.

The plumber will generally install and remove threaded pipe using wrenches that grip the exterior of the pipe when turning. These wrenches fall into two general categories: those with steel or other metal gripping teeth, and those with a compliant webbing.

The wrenches with steel teeth, of which the common pipe wrench is an example, are adjusted to apply a gripping force to the pipe while the pipe is being turned. As the turning force is applied, the grip is increased, and the pipe is turned.

The wrenches with compliant webbing, such as a strap wrench, consist of a metal handle and a piece of webbing, one end of which is attached to the handle. The free end of the webbing is fed around the pipe to be turned and then through a feature in the handle. As the handle is turned, the handle pinches the strap against the pipe and tightens the strap while simultaneously turning the pipe. A strap wrench described above generally does not have the excellent gripping force of the common pipe wrench with steel teeth. The strap wrench takes a considerable amount of time to install and remove from a pipe before and after turning the pipe, especially when compared to a common pipe wrench.

The wrenches with steel teeth that grab the external surface of the pipe to be turned can destroy the external threads especially when short nipples are being turned by the wrench and insufficient unthreaded portions of the nipple are available to grip. Further, external pipe wrenches often leave unsightly and disfiguring teeth marks on the outer surface of the pipe. This is unacceptable for pipe that is, for example, chrome plated and is not hidden from view. An alternative solution to those problems is the use of compression couplings or other types of fittings to join the pipe sections. However, this is more expensive, and a much more time consuming alternative and is often less reliable.

Actual deformation of a thin wall pipe is possible when a common pipe wrench is used to remove an old, rusted section of the pipe. This is due to the crushing action of the opposing steel teeth across the diameter of the pipe. The same crushing of the pipe may occur when using a strap wrench, since the handle of the wrench presses directly on the pipe as it pinches the strap against the pipe.

Further, all wrenches that engage the external surface of a pipe require some amount of room around the pipe to effectively turn the pipe. For some wrenches, such as the conventional pipe wrench, the amount of room can be considerable, and there are others designed for use in a confined space. However, the wrenches designed for confined space often have severe limitations in terms of ease of use and gripping power, and they always require at least some access to the external portion of the pipe.

In addition to the limitation of requiring a considerable amount of room for operation, the common pipe wrench, the strap wrench, and most other devices for turning a pipe are unidirectional in their operation. In other words, the pipe wrench, when being used for turning the pipe, may only turn the pipe in one direction. In order to reverse the direction of turning, the wrench must be removed from the pipe and turned to grip the pipe from the opposite direction, and reinstalled onto the pipe.

External pipe wrenches also have limitations for assembly in production factory environments. In such environments speed is paramount. Since the common methods of turning a threaded component with a pipe wrench are slow and cumbersome, much time is wasted using conventional pipe wrenches. Designers of such articles, realizing the slow and cumbersome assembly of threaded pipe oftentimes revert to other more expensive types of couplings. The cost savings realized in using threaded pipe can be substantial since the threading operation can be simply automated in a machining step that only takes a few seconds for both the pipe and the article receiving the pipe. The cost of a separate coupling, including a fastener to engage the coupling, may be much more expensive than the threaded interface. In addition, the threaded interface may provide a more esthetic result.

For example, the assembly of articles such as furniture that use components that are cylindrical pipes, such a chrome pipes, may be difficult to assemble using standard pipe wrenches, without marring the exterior cosmetic surface. In addition, high-speed production in factories that assemble boilers, sprinkler systems and components, furnaces, and other systems that use threaded pipe can be substantially limited by the use of a standard pipe wrench. As pointed out above, pipe wrenches are slow and cumbersome, require extra room to maneuver and operate and are generally not effective in a high-speed factory assembly production operation.

Various types of internal pipe wrenches solve some of these problems. For example, U.S. Pat. No. 5,207,131 issued to Pool, et al. discloses an oil filter removal tool. The disadvantage of the Pool, et al. device is that it includes springs 44 that bias the jaws of 48, 50 in an outward direction so that the jaws 48, 50 have to be depressed and urged inwardly to be inserted into an oil pan filter cap. U.S. Pat. No. 3,902,384 discloses an internal pipe wrench that has a tapered actuation element that must be adjusted to engage the inner surface of the pipe. Again, this is time consuming and has potentially other numerous disadvantages. Internal pipe wrenches available from BrassCraft have an offset pivot shaft on which a collar is mounted so that the collar becomes offset as the collar rotates around the offset shaft. The offset shaft that causes the collar to become offset and engage the internal portion of the pipe causes the device to be off center so that high speed assembly or disassembly is not achievable using the BrassCraft tools. In addition, the collar constitutes a single piece and does not tend to engage the inner surface of the pipe or nipple well. In addition, the rotatable sleeve must be oriented in a vertically downward position in order to engage a pipe when employed in a horizontal or nearly horizontal position. In that way, gravity can cause the sleeve to rotate in sync to its lowest point to engage the internal surface of the pipe. Since the sleeve has to be at the bottom, this limits the ease of use of the device. Further, in vertical orientations, the BrassCraft device may fail to easily engage the inner surface of the nipple. Further, the sleeve, because of its small size, may deform the pipe and could egg the pipe especially when engaging thin wall pipe. Further, in vertical alignment applications the user's fingers may have to be used to orient the rotatable sleeve in the correct position in order to insert the brass craft internal pipe wrench.

It would therefore be advantageous to provide a coupler that can securely grip a pipe, driveshaft or other shaft (hereinafter collectively referred to as a "torque receptor") from the inside without marring the outside, support a thin walled torque receptor such as a pipe so that the pipe does not deform while turning even under relatively high forces, be compact and able to work in extremely tight spaces, be simple and quick to use, insert, extract, be universal in direction, and aligned with the center axis of the torque receptor when engaged.

SUMMARY OF THE INVENTION

The present invention overcomes the disadvantages and limitations of the prior art by providing a simple and reliable device for engaging the internal diameter of a pipe, tube, rigid conduit or similar object, a drive coupler, torque transmitter or torque coupler, etc., all of which should be considered to be included in the term "pipe," "shaft," or "receptor." By gripping only the internal surface of the pipe, the external surface is left free from marks and the pipe is supported from any deformation. Further, since the handle or other mechanism for turning the wrench can be configured in many different ways, and almost the entire gripping mechanism is located inside the pipe, the space around the pipe that is required to turn the pipe is minimal. The present invention may also be universal in direction (i.e., can be operated in either turning direction without making any adjustments) so that the user does not have to think about the proper orientation prior to use.

The present invention may therefore comprise a coupler that is adapted to engage a cylindrical concave internal surface of a cylindrical opening of a torque receptor comprising a shaft that rotates around a center axis, the shaft having at least two cam driving surfaces that are spaced substantially equally from the center axis and that are adapted to transmit torque applied to the shaft; at least two gripping shells having axial end portions and convex external gripping surfaces that have a cylindrical convex profile and that slidingly engage the cylindrical concave internal surface, the gripping shells further including internal cam follower surfaces that are adapted to be engaged by the cam driving surfaces so that torque applied to the shaft is transmitted from the cam driving surfaces to the internal cam follower surfaces so that the center axis of the shaft is substantially aligned with a center axis of the cylindrical opening; retaining recesses that axially and radially retain the gripping shells on the coupler adjacent the shaft and that allow the gripping shells to move freely in a radial direction and that allow the gripping shells to automatically engage the cylindrical concave internal surface of the cylindrical opening.

The present invention may further comprise a wrench for engaging an internal surface of a pipe and turning the pipe in either direction comprising a shaft that rotates around a center axis, the shaft having at least two cam driving surfaces that are spaced substantially equally from the center axis for transmitting torque applied to the shaft; at least two gripping shells having external convex gripping surfaces that are cylindrically shaped, the external convex gripping surfaces disposed on the gripping shells to slidingly engage the cylindrically shaped concave internal surface of the pipe, the gripping shells further including internal cam follower surfaces that are designed to be engaged by at least two cam driving surfaces on the shaft so that the torque applied to the shaft is transmitted to the at least two gripping shells from the center axis in a direction that is substantially transverse to the center axis so that the gripping shells apply force to the cylindrically shaped concave internal surface of the pipe and the center axis of the shaft is substantially aligned with a center axis of the pipe; a retainer that engages the gripping shells to retain the gripping shells on the wrench adjacent the shaft and allows the shells to freely move, without being biased, in a direction that is transverse to the center axis to automatically open and engage the internal surface of the pipe.

The present invention may also further comprise a method of fabricating a wrench that is adapted to engage the internal surface of a pipe to turn the pipe comprising providing a shaft adapted to receive a torque to turn the pipe around a center axis of the shaft, the shaft having at least two cam surfaces that are adapted to transmit torque applied to the shaft; providing at least two gripping shells each having at least one external gripping surface and at least one internal cam follower surface, the external gripping surface having a convex cylindrical shape that slidingly engages the concave cylindrically shaped internal surface of the pipe, and the internal cam follower surface being adapted to engage at least one of the cam driving surfaces on the drive shaft so that torque applied to the shaft is substantially symmetrically transmitted to the at least two gripping shells from the shaft in a direction that is substantially transverse to the center axis so that the gripping shells apply force to the concave cylindrically shaped internal surface of the pipe and the center axis is substantially aligned with a center axis of the pipe; and providing a retainer that engages the gripping shells to retain the gripping shells on the wrench adjacent the shaft and allows the shells to move freely, without being biased in the substantially transverse direction so that the shells automatically open and engage the internal surface of the pipe.

The present invention may also further comprise a method of turning a pipe with an internal pipe wrench comprising gripping a concave cylindrical internal surface of the pipe with one or more gripping shells of the internal pipe wrench, the gripping shells having convex gripping surfaces that are cylindrically shaped to slidingly engage the concave cylindrical internal surface of the pipe, the gripping shells further including cam follower surfaces that are adapted to be engaged by cam driver surfaces of a cam driver that apply torque to the cam follower surfaces causing the gripping shells to expand and engage the internal surface of the pipe so that the pipe is substantially aligned with the center axis, the gripping shells retained on the internal pipe wrench with a retainer that allows the gripping shells to move freely, without being biased so that the gripping shells automatically open and engage the concave cylindrical internal surface of the pipe whenever torque is applied to the cam driver; applying a torque in either direction to the cam driver to cause the gripping shells to expand and engage the cam follower surface of the gripping shells; and turning the pipe in the direction of the torque.

The present invention may also further comprise a coupler that is adapted to engage a cylindrical concave internal surface of a cylindrical opening of a torque receptor comprising a shaft that rotates around a center axis, the shaft having at least two cam driving surfaces that are spaced substantially equally from the center axis and that are adapted to transmit torque applied to the shaft; at least two gripping shells having axial end portions and convex external gripping surfaces that have a cylindrical convex profile and that slidingly engage the cylindrical concave internal surface, the gripping shells further including internal cam follower surfaces that are adapted to be engaged by the cam driving surfaces so that torque applied to the shaft is transmitted from the cam driving surfaces to the internal cam follower surfaces so that the center axis of the shaft is substantially aligned with a center axis of the cylindrical opening; retaining recesses that axially and radially retain the gripping shells on the coupler adjacent the shaft and that allow the gripping shells to move freely in a radial direction and that allow the gripping shells to automatically engage the cylindrical concave internal surface of the cylindrical opening; a driver connected to the shaft, the driver having a cylindrical collar portion that is substantially aligned with the center axis, the cylindrical collar portion having an interior cylindrical surface that is adapted to receive the torque receptor and provide structural support for the torque receptor to prevent ovaling and structural failure of the torque receptor.

The present invention may also further comprise a wrench for engaging an internal surface of a pipe and turning said pipe in either direction comprising a shaft that rotates around a center axis, the shaft having at least two cam driving surfaces that are spaced substantially equally from the center axis for transmitting torque applied to the shaft; at least two gripping shells having external convex gripping surfaces that are cylindrically shaped, the external convex gripping surfaces disposed on the gripping shells to slidingly engage the cylindrically shaped concave internal surface of the pipe, the gripping shells further including internal cam follower surfaces that are designed to be engaged by at least two cam driving surfaces on the shaft so that the torque applied to the shaft is transmitted to the at least two gripping shells from the center axis in a direction that is substantially transverse to the center axis so that the gripping shells apply force to the cylindrically shaped concave internal surface of the pipe and the center axis of the shaft is substantially aligned with a center axis of the pipe; a retainer that engages the gripping shells to retain the gripping shells on the wrench adjacent the shaft and allows the shells to freely move, without being biased, in a direction that is transverse to the center axis to automatically open and engage the internal surface of the pipe; and a driver connected to the shaft, the driver having a cylindrical collar portion that is substantially aligned with the center axis, the cylindrical collar portion having an interior cylindrical surface that is adapted to receive the pipe and provide structural support for the pipe to prevent ovaling and structural failure of the pipe.

The advantages of the present invention include time savings, ease of use and the ability to employ the present invention in tight spaces where other devices for turning the pipe or torque transmitter, such as a driveshaft could not be used, such as with a standard external pipe wrench. The coupler can be employed with a ratchet which saves time and allows the coupler to turn pipes and torque transmitters in spaces that may be too tight for a standard external pipe wrench or other drive couplers. The compactness of the coupler, and the fact that the coupler accesses the pipe from a different direction and in a different way than a standard external pipe wrench or drive copuler, allows the coupler to be effectively used in situations that are not conducive to other techniques of handling pipes or torque transmitters. In addition, the coupler can be used where nipples cannot be accessed by a pipe wrench, or where threads on short nipples cannot be marred in either the loosening or tightening process. Further, the coupler can be used to remove broken off pipes that are threaded into a fitting, which may frequently occur with the use of plastic pipes. Also, standard ratchet extension bars can be used with the coupler to access hard to reach locations to both tighten and loosen pipe. The present invention is simple in design has a few mechanical moving parts and operates automatically to grip the internal surface of a pipe in either direction to allow either tightening or loosening of the pipe or driving of a driveshaft in either direction. The weight of the jaws or shells of the wrench of the present invention helps the jaws to automatically open and engage the internal surface of the pipe or torque transmitter. Further, the resisting inertia of the jaws, due to the mass of the jaws, helps to open the jaws when the cam first starts turning. Further, the coupler is designed so that the pipe end engages the face of the shells or jaws of the coupler which generates friction between the pipe and the jaws to help the jaws stay in a stationary position as the cams function to open the jaws. As a result, the coupler is simple and easy to use due to the elegance of the design. Another embodiment of the coupler can be used as an alignment device to align pipes for butt end welding. Further, the coupler can be used for power drive applications that allows a receptor unit (torque transmitter) to be driven in either direction. Collars prevent ovaling of the driveshaft.

The coupler can also be used in conjunction with a ring placed on the outside of the pipe to prevent the pipe from ovaling, such as may occur with thin wall pipes or shafts, and to maintain the structure and rigidity of a rusted pipe or shaft. Another advantageous feature of the coupler is that the shells include depressed regions that provide room for ridges that may typically be formed at the end of cheaply constructed pipes, such as cheaply made nipples. This allows the spline surfaces or other rough surface of the shell to engage the inner surface of the nipple without interference from the ridges that are formed by these cheaply made nipples.

Another advantage of the coupler is that the shoulders at the rear portion of each shell engaging section butt against the end of the nipple which causes the shells to rotate with the nipple and create movement between the shaft and the shells so that the shells engage the inner surface of the nipple. To assist in this function, a frictional surface can be created on the shoulder portions such as serrations, knurling or other frictional surface. As such, the butt end of the nipple engages the shoulder of the shells with a greater coefficient of friction to thereby enhance this advantageous functionality of the present invention. In addition, various types of frictional material can be used on the outer portions of the shells as well as the shoulder portions including serrating, splines, diamond grip surfaces, rubber grip surface, knurling, et cetera. In some applications, even a smooth surface may be advantageous because of the nature of the pipe that is to be turned.

DETAILED DESCRIPTION OF THE INVENTION

Figure 1:
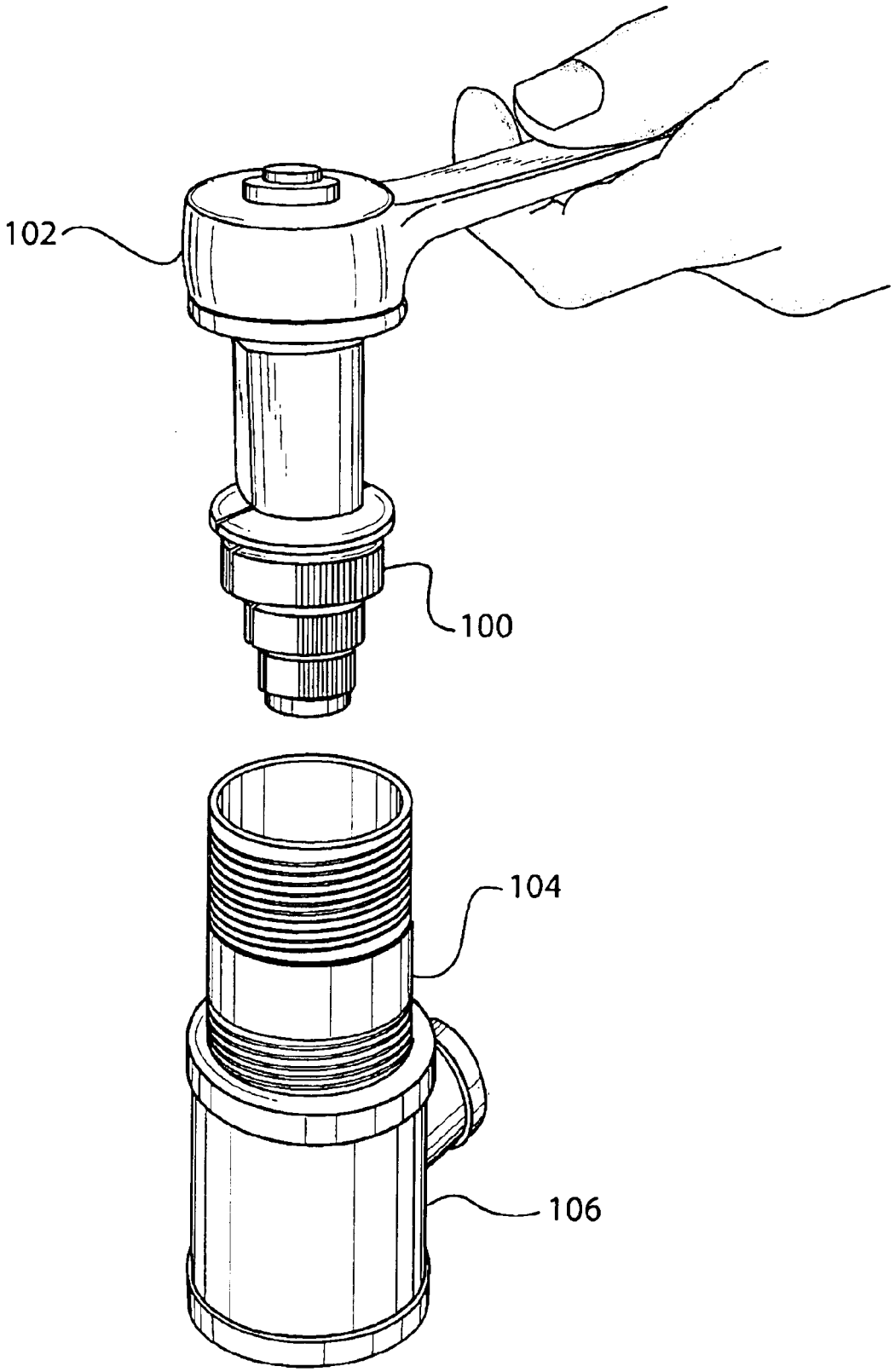
FIG. 1 is a perspective view of one embodiment of the present invention.

FIG. 1 is a perspective view of one embodiment of the invention illustrating a pipe wrench 100 that is engaged by a common ratchet wrench 102. The wrench 100 is shown prior to being inserted into pipe 104 that is to be driven into fitting 106. As shown in FIG. 1, the wrench 100 has three staged portions of each of the jaws or shells that are capable of engaging the interior surface of three different sizes of pipes. Since the wrench 100 is constructed to engage the inner surface of pipes, such as pipe 104, the size and spacing of each of the engaging surfaces of the jaws of the wrench 100 is made for a particular size of inner diameter (ID) pipe. For example, black pipe that is used for gas connections has standard inner diameters for different size pipes. For example, ½ inch black pipe has a standard inner diameter that may be engaged by the smallest portion 108 of the jaws of the wrench 100. A ⅝ inch black pipe may have an inner diameter that is engaged by the middle portion 110 of the wrench 100. Further, a ¾ inch pipe may have an inner diameter that is engaged by the large portion 112 of the wrench 100. Alternatively, the present invention may be used with plastic pipe or other types of pipe that may have different inner diameters for the same size of outer diameter pipe. In this case, different sizes may be provided for each of the stages 108, 110, 112 of the wrench 100.

Figure 2:
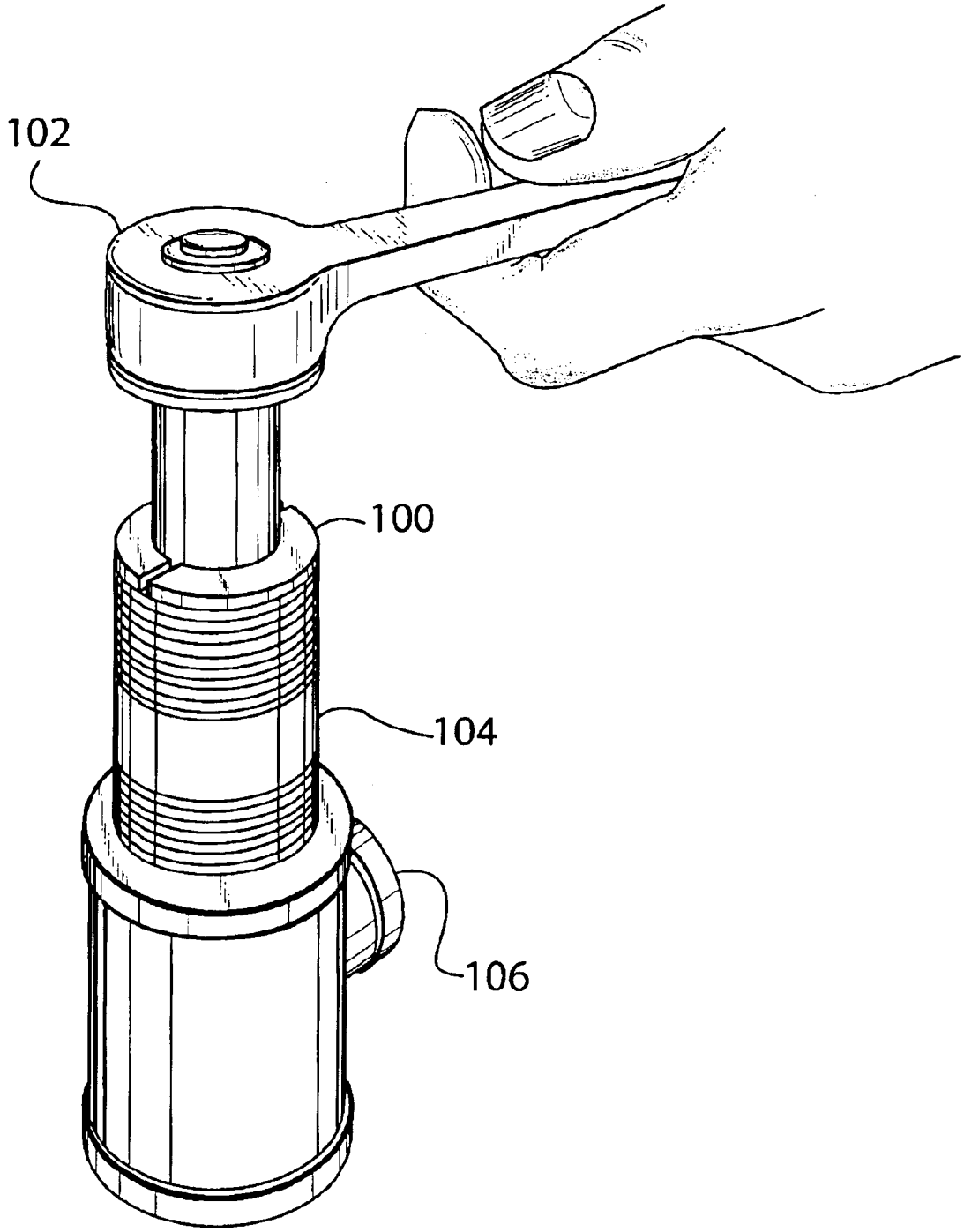
FIG. 2 is a perspective view of one embodiment of the invention.

FIG. 2 is a perspective view similar to FIG. 1, wherein the pipe wrench 100 is being driven by a common ratchet wrench 102, and is fully engaged with the interior surface of pipe 104 that is to be driven into fitting 106. In this view, it is apparent how little space is occupied by the pipe wrench 100, which is barely visible outside of the pipe 104. In this embodiment, a common ratchet wrench 102 is used to drive the pipe wrench 100. For areas where access is limited, common ratchet wrench extensions and other common ratchet wrench drivers can be used.

Figure 3:
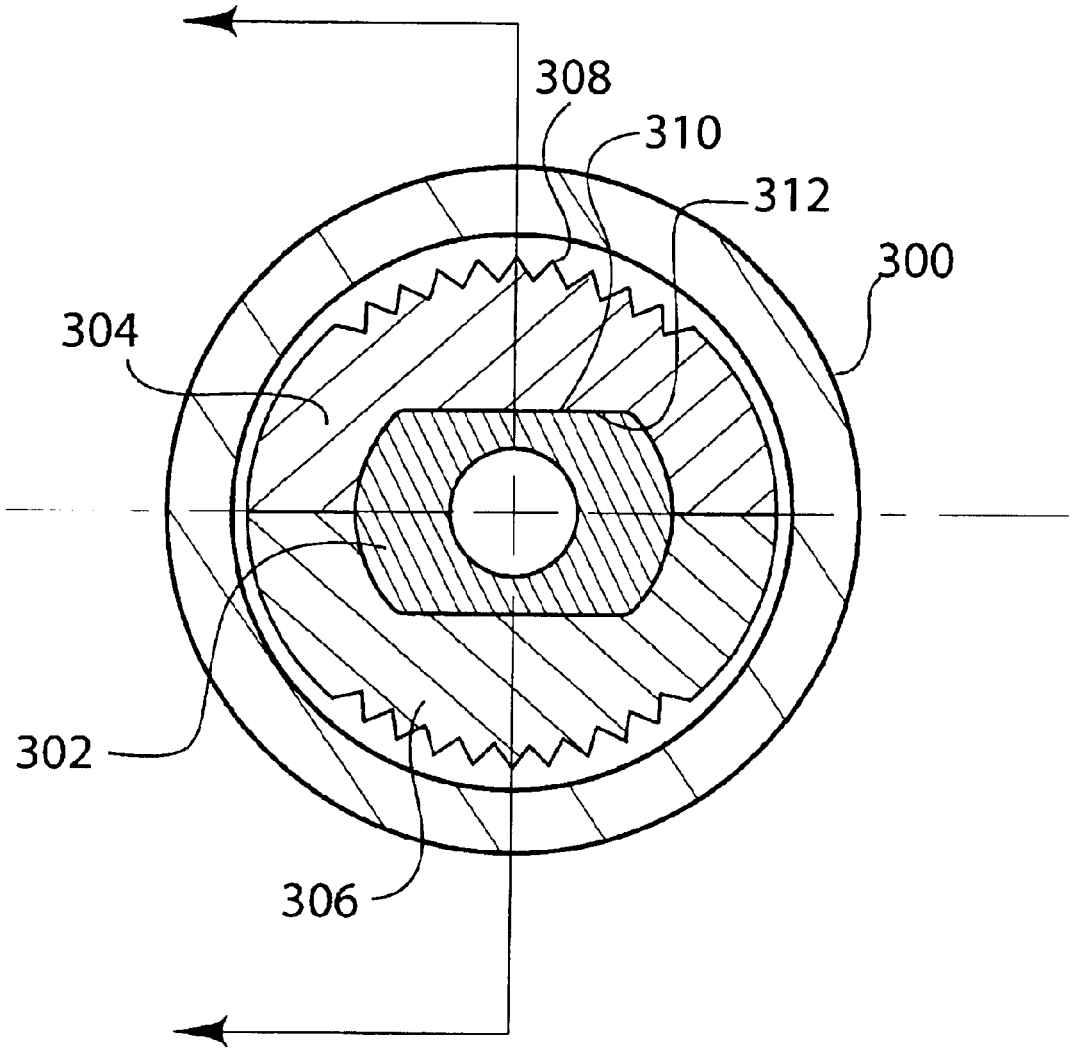
FIG. 3 is a cross-section view of one embodiment of the inventive pipe wrench taken normal to the axis of a pipe, with the wrench in the collapsed position.

FIG. 3 shows a cross-sectional view of the wrench illustrated in FIGS. 1 and 2 that is inserted into a pipe 300 prior to engagement. FIG. 3 illustrates the drive shaft 302, first gripping shell or internal jaws 304, and second gripping shell or internal jaws 306. For the purposes of simplicity, the gripping shells, which are also referred to as internal jaws, are referred to throughout the remainder of this description as gripping shells. It should be understood that the term gripping shells should not be interpreted to limit the scope of this invention. The gripping shell 304 has external gripping surface 308 and internal cam surface 310, which is touching the cam surface 312 of drive shaft 302.

Figure 4:
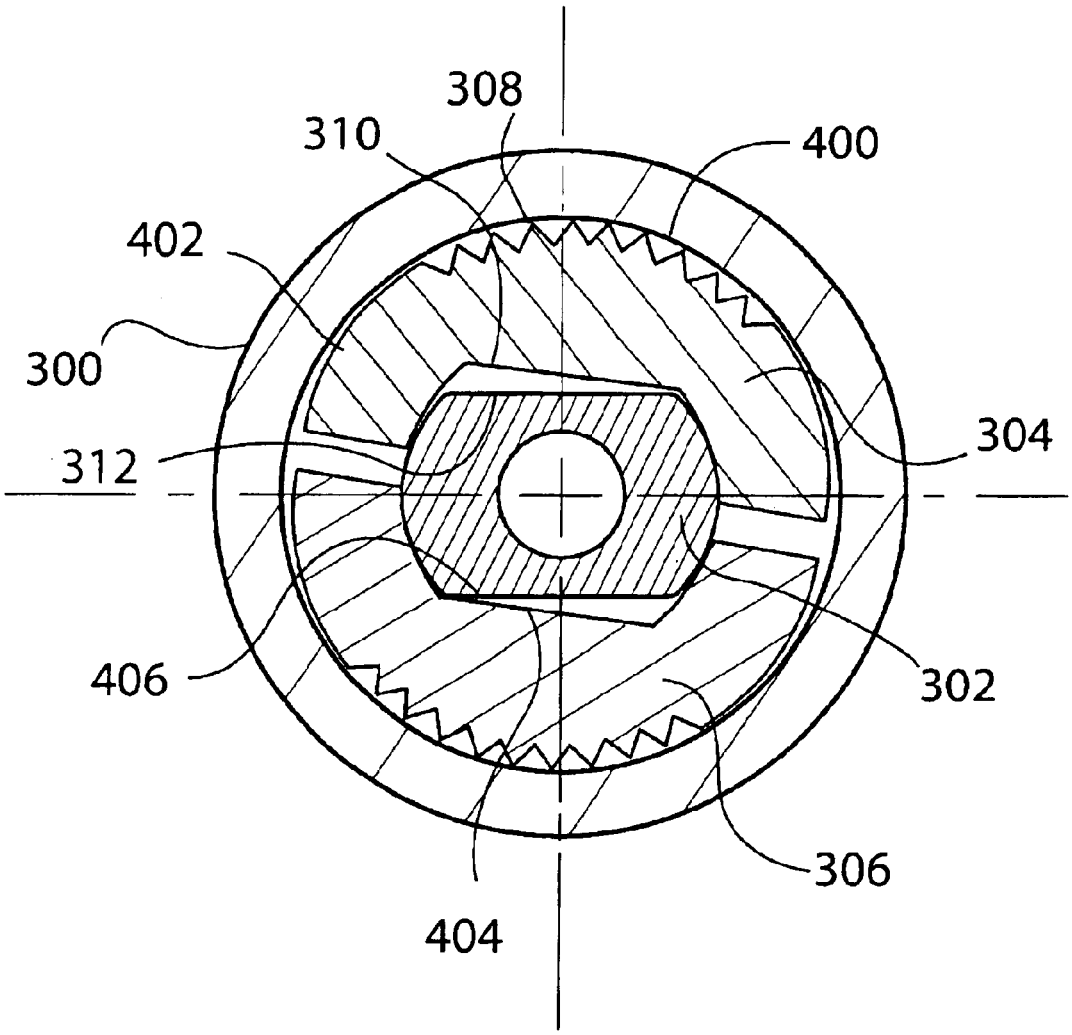
FIG. 4 is a cross-section view of one embodiment of the inventive pipe wrench with the wrench in an engaged position.

FIG. 4 shows a cross-sectional view of the wrench illustrated in FIGS. 1–3 showing engagement of the wrench on the interior surface 400 of pipe 300. FIG. 4 illustrates the drive shaft 302, first gripping shell 304, and second gripping shell 306. The drive shaft 302 is rotated to the point that it forces gripping shells 304 and 306 to press against the internal surface 400 of the pipe 300. The torque to the drive shaft 302 is applied in a counter clockwise motion. In the embodiment shown in FIGS. 1–4, the outer surface of gripping shell 304 has a radius 402 that is smaller than the internal radius of the pipe 400. This design allows the gripping teeth 308 to grip the internal surface 400 of the pipe 300 over a wide area while not distorting the internal shape of the pipe 300. The gripping teeth 308 can be made from hardened steel or any other material suitable for gripping the interior surface 400 of pipe 300.

Other shapes and materials can be used to grip the internal surface 400 of the pipe 300 illustrated in FIGS. 1–4. For example, the teeth 308 could be replaced with a tacky rubber surface, which will provide an adequate amount of grip yet not mar the internal surface of the pipe. Other malleable materials, such as a soft metal or plastic can be used if the internal surface 400 is not to be damaged. In fact, any type of gripping surface can be used in accordance with the present invention that is capable of transmitting a driving torque to the inner surface of a pipe or other object. For example, a sticky surface can be used or surfaces such as sandpaper or a knearled surface can be used to engage the inner surface of the pipe. The only constraint is that enough friction is created between the inner surface of the pipe or other object and the gripping shells to transmit the driving torque force to the pipe or other object this can be accomplished through the use of various shapes or substances, or a combination of the two.

Further, the present invention can be used with any desired type of pipe 300. Pipe may comprise metal pipe, plastic pipes of various types, tubes, rigid conduit, etc. In addition, the present invention can be used on objects other than pipes to transmit a rotational torque to the object. Hence, the term pipe should be interpreted to include any type of device that can be engaged by the internal jaws/gripping shells of the present invention. Also, the shapes of the gripping shells 304 and 306 may be selected to engage the internal surface of a round hole or other shapes as well. For those applications where the object to be turned is not a round hole, such as if the hole were square or elliptical, the shapes of the gripping shells 304 and 306 may be changed appropriately. Those skilled in the art may select many different gripping materials and shapes pertaining to their application. Further, the torque transmitted to the pipe can be used for various purposes such as motive driving torque, tightening or loosening threads, removing broken pipes, etc. For example, the present invention can be used where a single power source is used to drive various different pieces of equipment, and the power source can be easily engaged and disengaged from the equipment using a drive coupler in the form of a tube or pipe. This is more fully illustrated in FIG. 30, described below. In addition, the present invention can be used with large threading equipment that is used to thread pipe. Rather than have the large jaws that grasp and turn the pipe, the present invention can be used to handle the pipe during the threading process.

FIG. 4 further illustrates the cam mechanism that comprises internal cam surfaces 310 and 404 of the gripping shells 304 and 306, respectively, and the drive shaft cam surfaces 312 and 406. In the embodiment illustrated in FIG. 4, the cam surfaces are flat surfaces. However, a curved surface may be selected to change the ratio of circumferential expansion verses the torque applied to the pipe 300. For example, a sharply rising cam surface will not provide as much circumferential expansion per turning torque as would a slowly rising cam surface.

If the pipe 300 is too large for the wrench to turn, the gripping shells 304 and 306 will extend until the point where the highest point of the drive shaft 302 passes over the internal cam surfaces 310 and 404. In this case, the operator of the pipe wrench must select a different diameter gripping shell 304 and 306 to use. The size of the gripping shell and the size of the cam are designed to engage a certain percentage of the wall thickness of the pipe. For example, the "throw" of the shells may be designed to be 75% of the wall thickness of the pipe 300 to ensure that rusted pipes can be fully engaged. The size of the shells is also designed so that the unit can be easily inserted into the pipe without the necessity of manually closing the shells.

The pipe 300 as illustrated in FIGS. 1–4 represents a conventional plumbing pipe. For the purposes of this specification, the term pipe shall comprise conventional plumbing pipes, but also any device or article with an internal hole into which the inventive wrench can be inserted and caused to turn the device or article. An example would be the assembly of table legs in the manufacture of furniture, or the assembly of automotive components by engaging only an internal hole to screw the component to the assembly.

Figure 5:
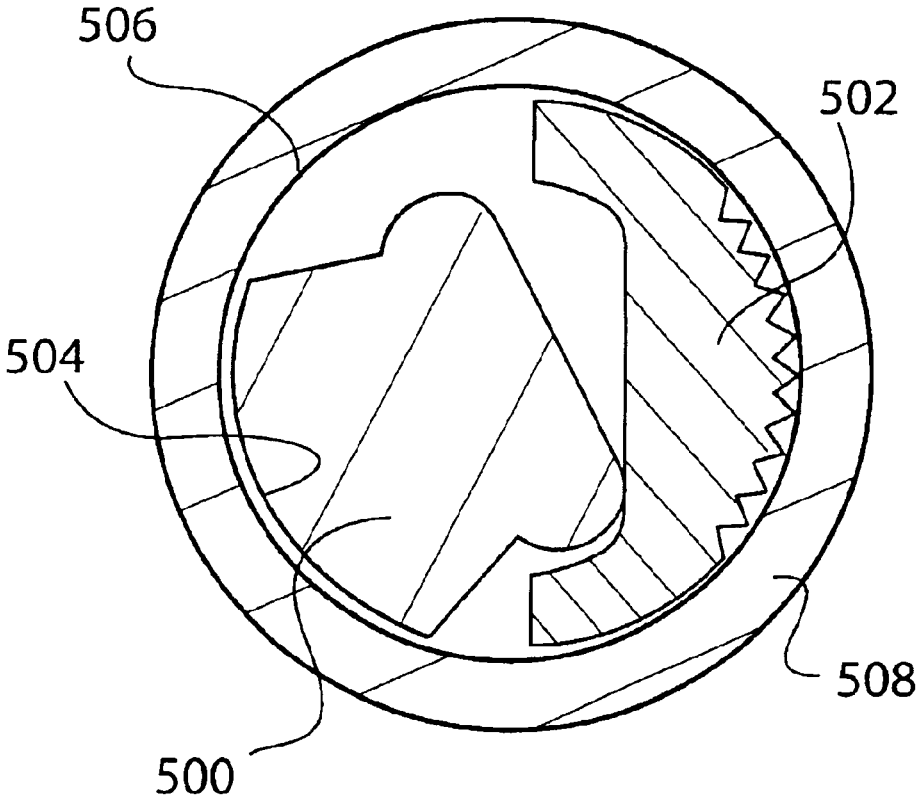
FIG. 5 is a cross-section view of an alternative embodiment of the invention illustrating a pipe wrench containing one gripping shell.

FIG. 5 illustrates an embodiment of the invention comprising a single gripping shell. The single gripping shell design comprises a drive shaft 500 and a single gripping shell 502, where one external surface 504 of the drive shaft 502 rests against the internal diameter 506 of the pipe 508. The drive shaft 502 has torque applied in a counter clockwise direction. The advantages of this design are the minimal number of moving parts and the simplicity of the design.

Figure 6:
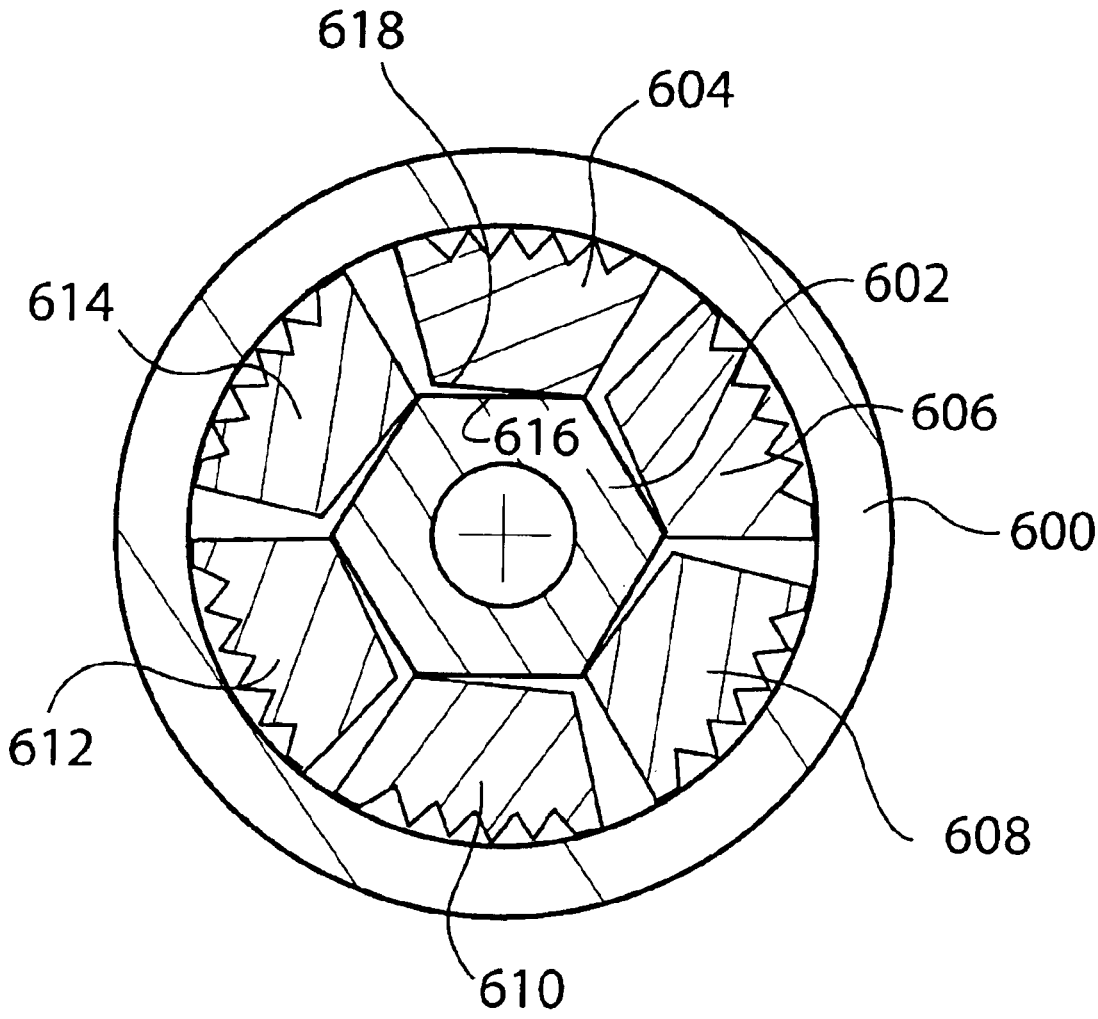
FIG. 6 is a cross-section view of another alternative embodiment of the invention illustrating a pipe wrench containing six gripping shells.

FIG. 6 illustrates an embodiment of the invention comprising six gripping shells. FIG. 6 illustrates the pipe 600, the drive shaft 602, and six gripping shells 604, 606, 608, 610, 612, and 614. The drive shaft 602 is shown turned so that the drive shaft cam surface 616 is forcing gripping shell 604 outward by pushing on its cam surface 618. The other gripping shells 606, 608, 610, 612, and 614 are similarly extended. The drive shaft 602 has torque applied in a counter clockwise direction. One of the advantages of a multiple gripping shell design is that the pipe is uniformly and evenly loaded with the circumferential expansion force of the gripping shells. By using a large number of gripping shells, the pipe is much less likely to deform or "egg" than when lesser numbers of gripping shells are used. For the remainder of the discussion, an embodiment 100 with two gripping shells will be discussed. It is readily obvious to one skilled in the art that all of the features discussed below may be applied to embodiments with any number of gripping shells.

Figure 7:
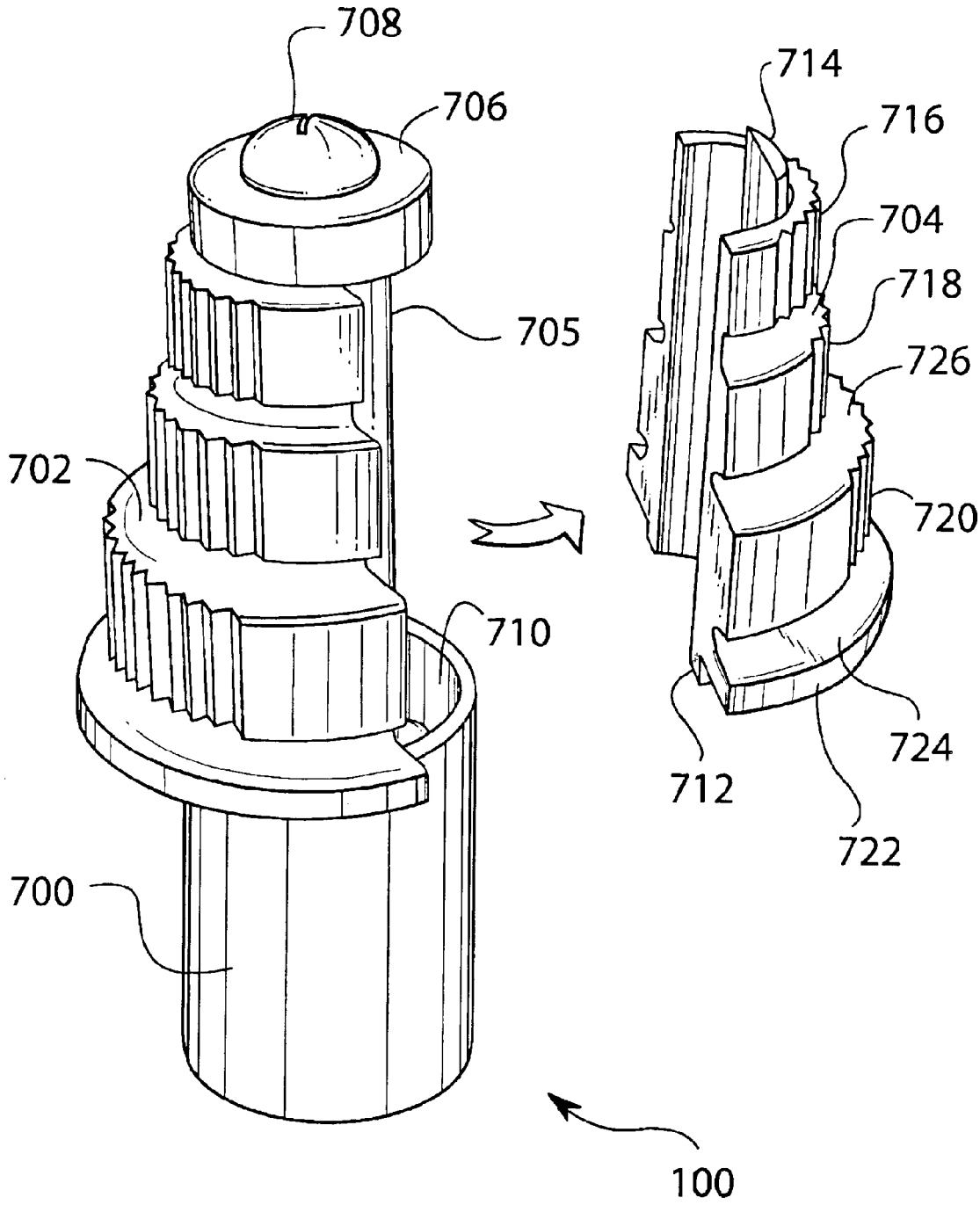
FIG. 7 is a semi-exploded view of one embodiment of the invention with one of the gripping shells exploded from the assembly.

FIG. 7 is a perspective view of a dual shell embodiment of the invention 100 in a semi-exploded state. FIG. 7 illustrates a drive socket 700, a first gripping shell 702, a second gripping shell 704, a drive shaft 705, an end cap 706, and an end cap retaining screw 708. Recess 710 in the drive socket 702 forms a retainer into which fits a bottom lip 712 of the second gripping shell 706. A similar lip 714 fits into a recess (shown in FIG. 9) on the underside of retaining cap 706. The retainer keeps the gripping shells attached to the wrench 100 when the wrench 100 is being stored or transported. The recess 714 and its counterpart on the underside of retaining cap 706 are both selected so that the gripping shells are able to expand when the center drive shaft 700 is turned. A gap is selected between the recess 710 and the lip 712 such that sufficient space is provided so that the drive shaft 700 can turn freely while the gripping shell 704 slides over the respective cam surfaces without binding between recess 710 and lip 712. An excess amount of space is not necessary since only enough space is needed to allow the drive shaft to completely turn with respect to the shells. This spacing, of course, is dependent upon the amount of throw that has been designed into the unit.

Figure 11:
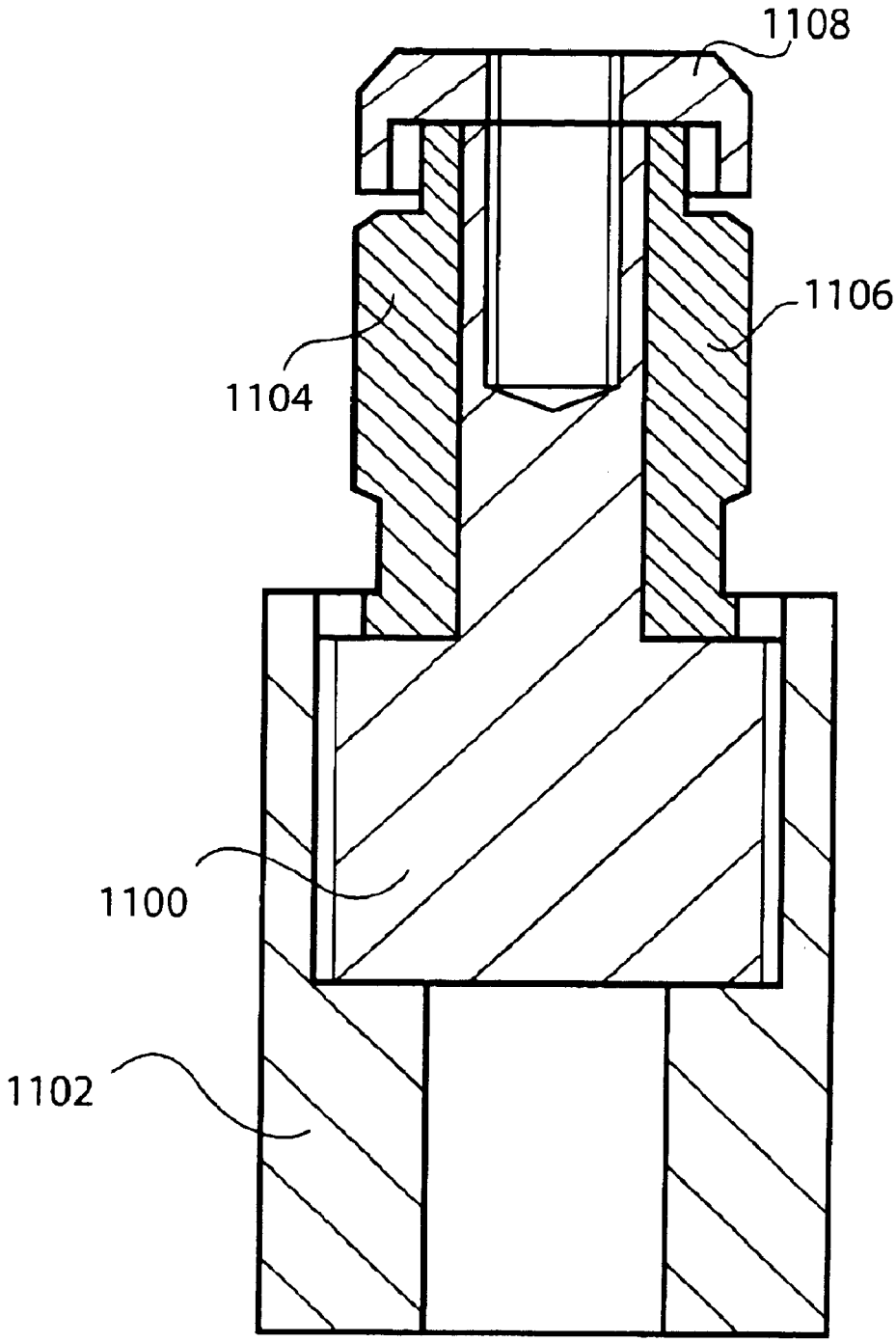
FIG. 11 is a cross-sectional view of one embodiment of the pipe wrench of the present invention that is constructed with a common wrench socket.
Figure 12:
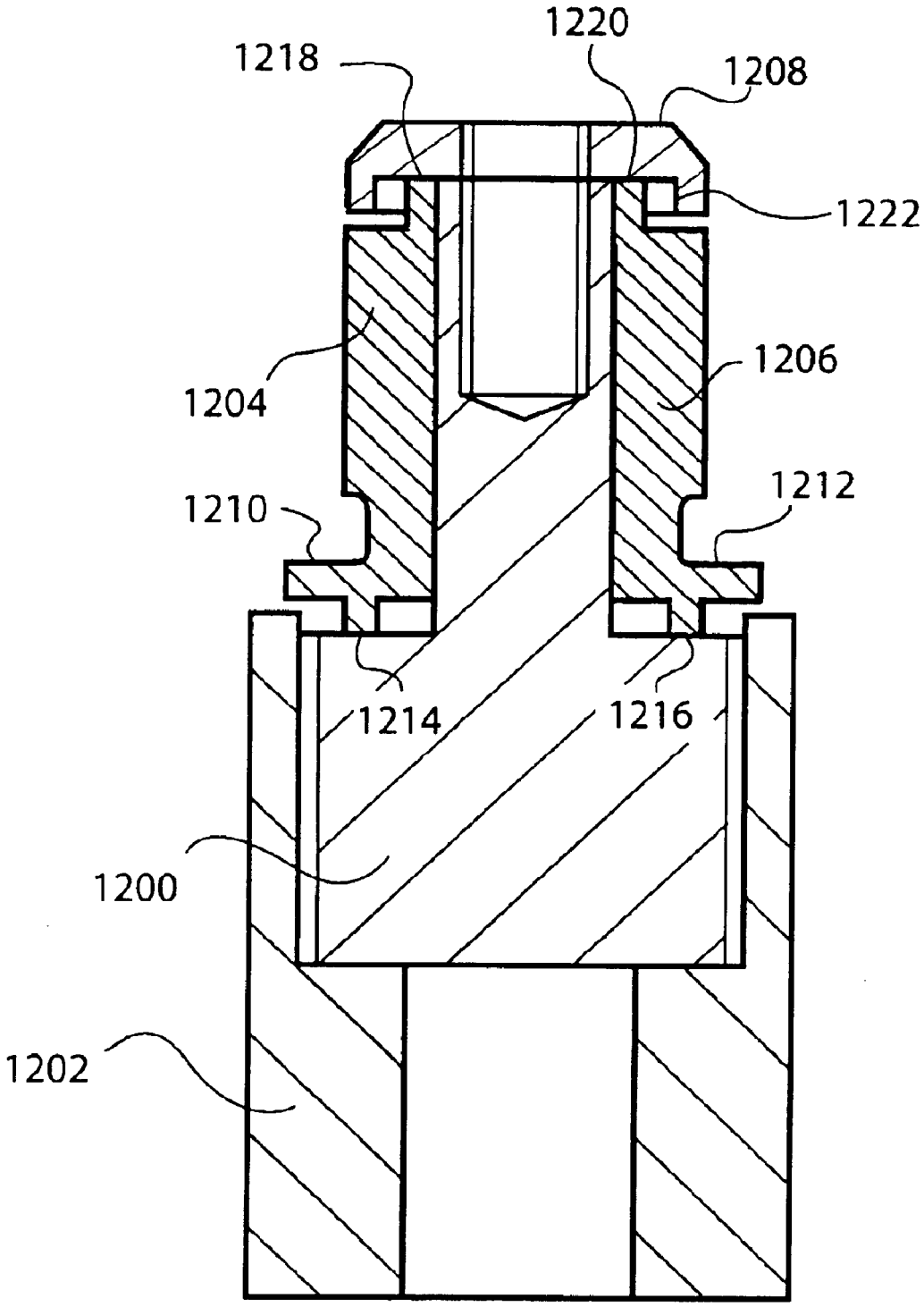
FIG. 12 is a cross-sectional view of another embodiment of the wrench of the present invention using a common wrench socket.
Figure 28:
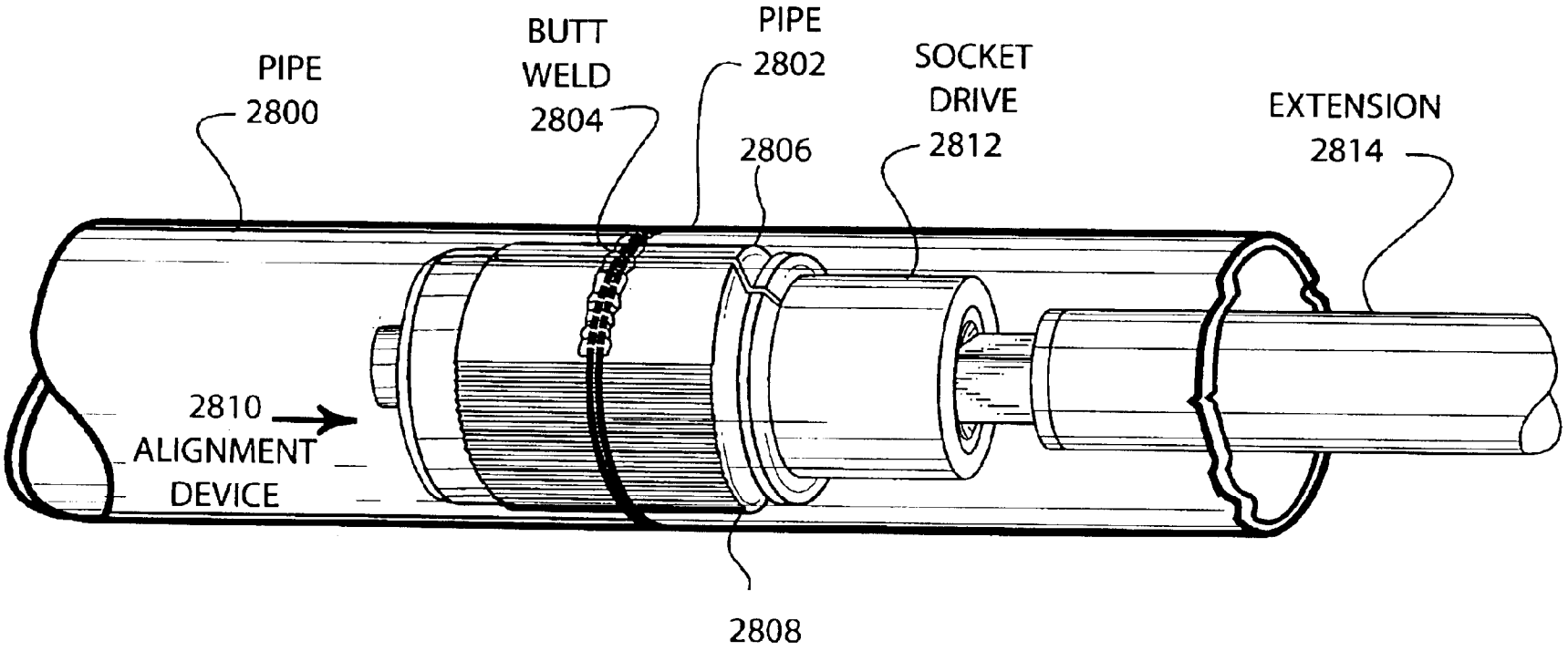
FIG. 28 is a perspective view of an alternative embodiment of the present invention that is used to align pipes for butt-welding.

As also shown in FIG. 7, the gripping shell 704 contains three gripping surfaces, 716, 718, and 720, each successively increasing in diameter. This embodiment is designed to turn three standard size pipes. When the largest size pipe is selected to be turned, the wrench 100 is slid into the open end of the pipe until the flange 722 seats against the end of the pipe. The flange 722 acts in several ways. One is to position the wrench 100 so that the gripping surface 720 fully engages the pipe to be turned. A second purpose of the flange 722 is to align the pipe wrench 100 with the axis of the pipe to be turned. A third purpose of the flange 722 is to provide a frictional surface 724 for the gripping shell 704 to engage the pipe. The face or shoulder 724 of the flange 722 engages the butt end of the pipe which causes friction to be created between the butt end of the pipe and the face 724. This friction helps to keep the gripping shells in a stationary position and resist rotation as the cam opens the shells so that the gripping shells engage the interior surface of the pipe. In other words, surface 724 functions to provide some friction that overcomes the frictional force of the cam mechanism and to allow the cam mechanism to force the gripping shell 704 outwardly until it engages the pipe to be turned. Frictional surfaces can be designed into the shoulder portions as shown in FIG. 28. The existence of the shoulder is particularly useful if a hand device is used to drive the pipe wrench 100, such as with a hand operated ratchet wrench as in FIG. 1, a common pipe wrench as in FIG. 11, an integral handle that is part of the drive shaft, or other hand operated device. For powered devices, such as with a pneumatic powered ratchet, as shown in FIG. 12, an electric drill, or other powered torque devices, the centripetal force provided by the mass of the gripping shells 702 and 704 may also help to initiate the engagement of the inner diameter of the pipe and begin the cam action.

For the smaller diameter-gripping surface 718 shown in FIG. 7, the surface or shoulder 726 provides the same functions as surface or shoulder 724 does for gripping surface 720. FIG. 7 illustrates an embodiment with three gripping surfaces, 716, 718, and 720. Alternatively, embodiments may contain between one and a multitude of gripping surfaces. The gripping surfaces 716, 718, and 720 are designed to grip the internal diameter of a pipe that has a constant diameter. For turning pipes or other articles that have a tapered or other specially shaped bore, the gripping surfaces may be shaped to match the internal surface of such an article.

Figure 8:
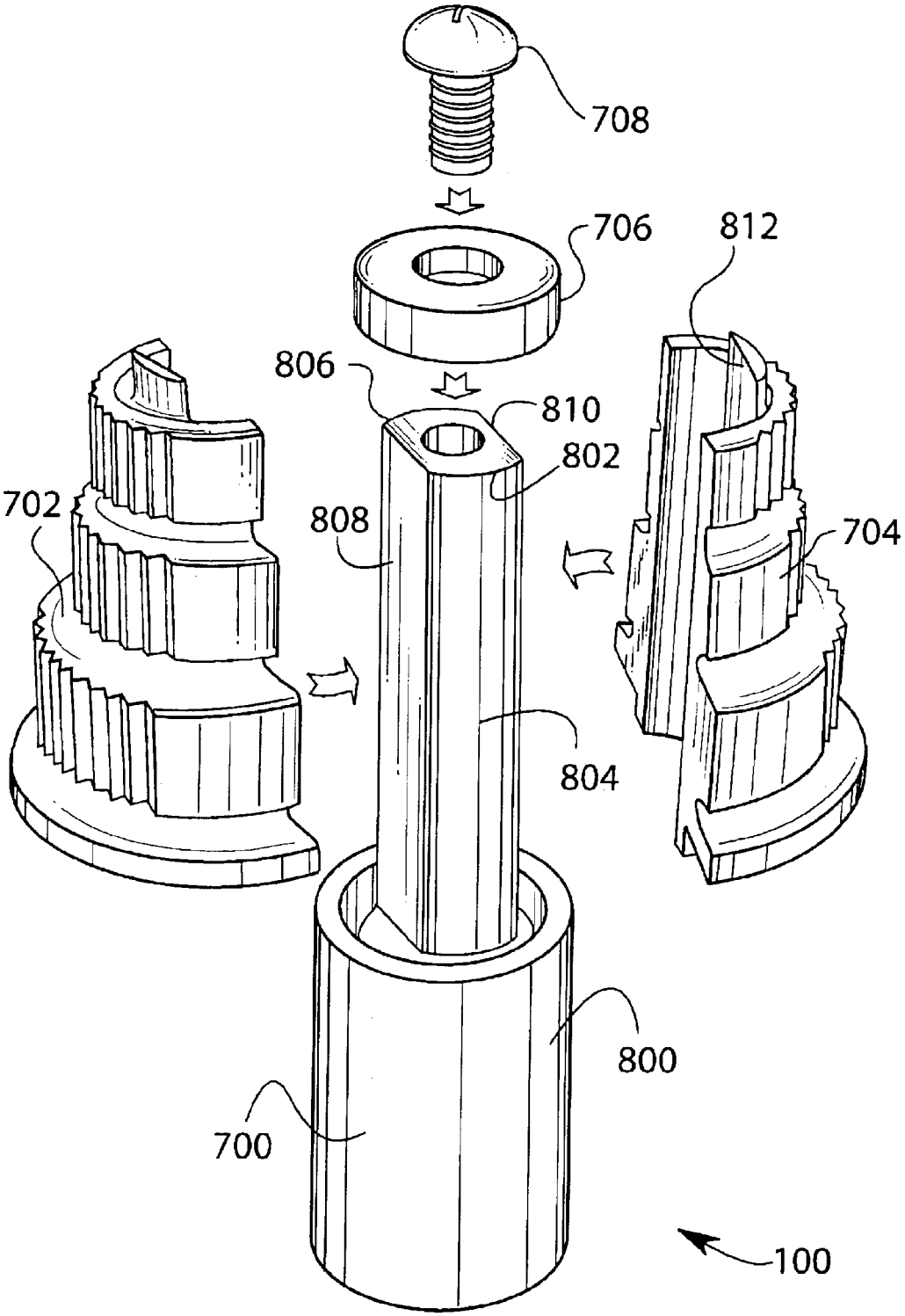
FIG. 8 is a fully exploded view of the embodiment of FIG. 7.

FIG. 8 shows a perspective view of a fully exploded assembly 100. The assembly 100 comprises a drive socket 700, first gripping shell 702, second gripping shell 704, retaining cap 706, and retaining cap screw 708. An alternative embodiment may include a retaining cap that incorporates an integral threaded feature and eliminates the screw 708 from the assembly. The drive socket 700 comprises a driven end 800 and the drive shaft 802. The drive shaft 802 contains curved surfaces 804 and 806 and flat surface 808 and 810. The cam surface 810 rests against gripping shell cam surface 812 when the gripping shells 702 and 704 are retracted.

Figure 9:
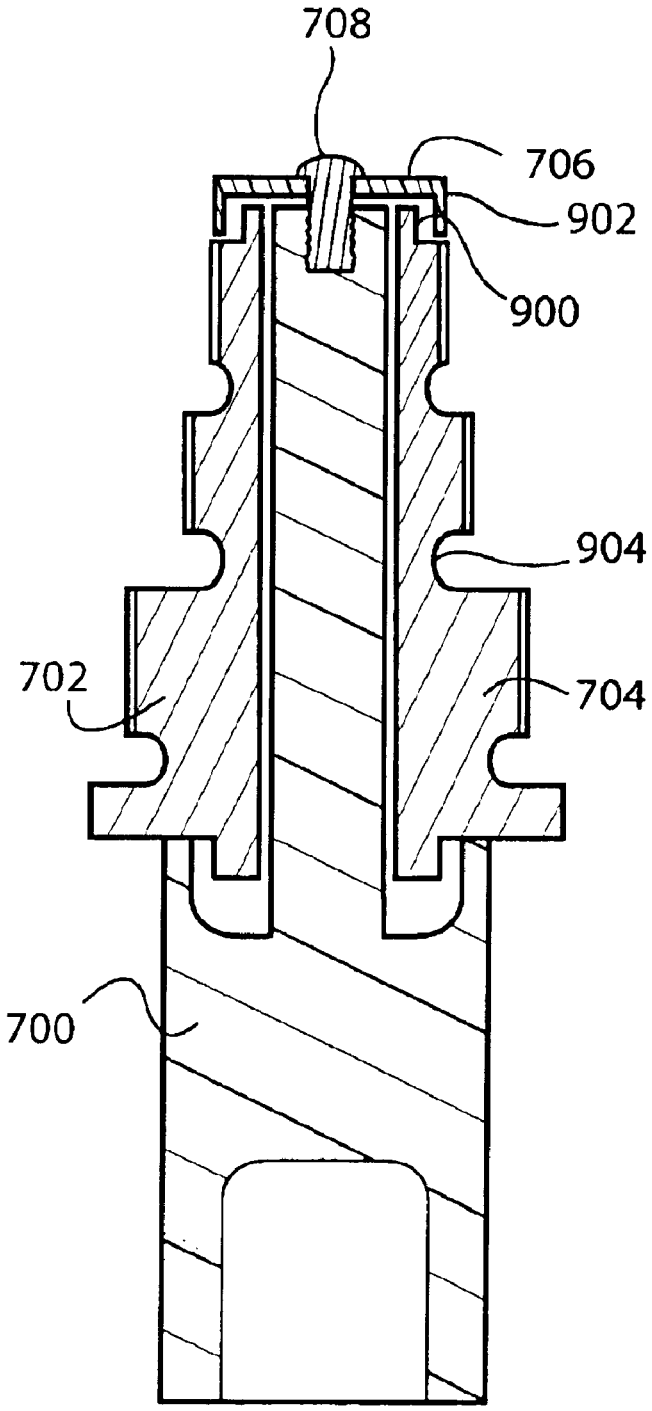
FIG. 9 is a cross-section view of the embodiment of FIG. 7 taken parallel to the axis of the pipe.
Figure 30:
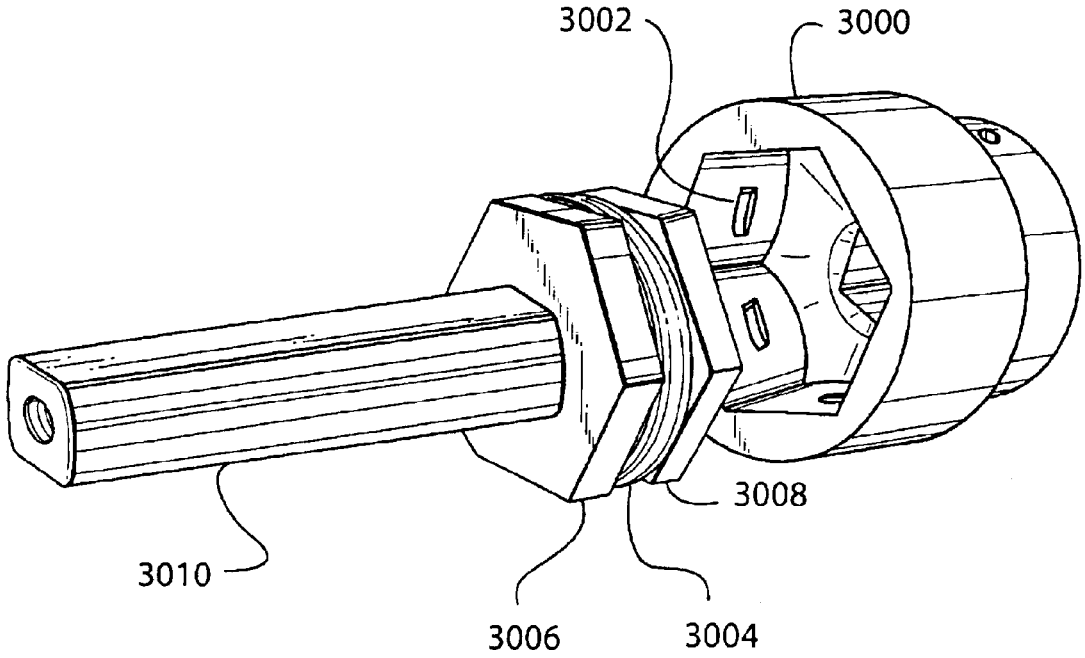
FIG. 30 is a perspective view of the manner in which a drive shaft may be removably coupled to a socket.

FIG. 9 illustrates a cross-sectional view of the inventive pipe wrench 100 taken parallel to the axis of the pipe. FIG. 9 illustrates a drive shaft 700, a first gripping shell 702, a second gripping shell 704, a retaining cap 706, and a retaining cap screw 708. The drive socket and drive shaft are incorporated into one piece as shown in FIG. 9. These can be made into two separate pieces if desired as illustrated in FIGS. 11, 12 and 30. The gripping shell 704 has upper retaining lip 900 that is retained by the lip 902 of retaining cap 706. The retaining cap lip 902 of the retaining cap 706 forms a recess that retains the retaining lip 900 of the gripping shell 704. The gap between the drive shaft 700, the upper retaining lip 900 and the retaining cap lip 902 is selected so that the drive shaft can turn and the cam mechanism push the gripping shell 704 outward to its fullest extent while still maintaining a slight gap between lips 900 and 902. Alternative designs exist for retaining the gripping shells 702 and 704 onto the drive shaft 700. For example, the shells may be constrained axially by mechanical stops along the axis of the drive shaft 700, or by a hoop of wire, a ring such as a metal or rubber O-ring that rides in the slot 904 or other locations. Other retention designs are well within the purview of those skilled in the art.

Figure 10:
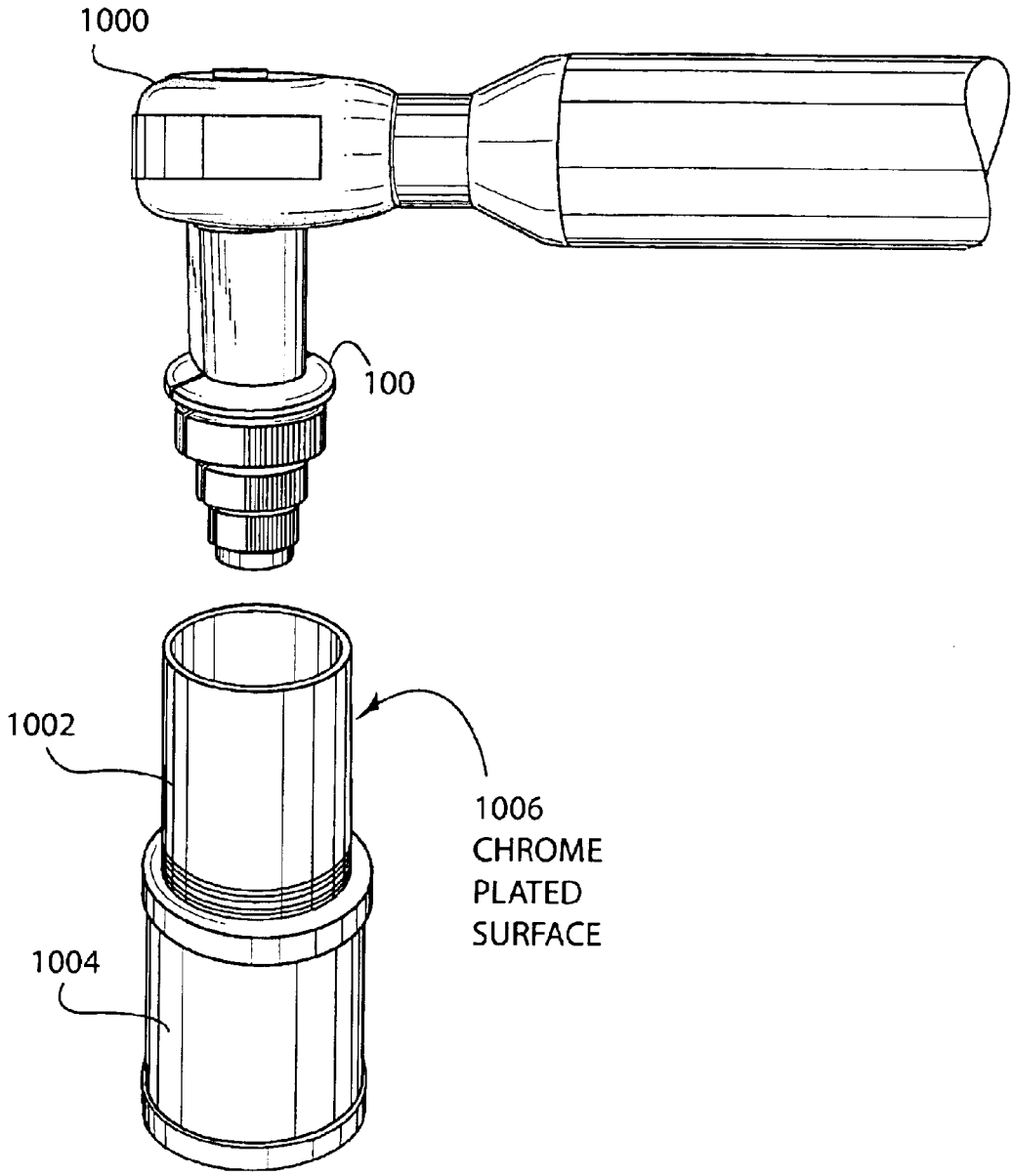
FIG. 10 is a perspective view of an embodiment of the present invention driven by an automatic pneumatic ratchet wrench.

FIG. 10 illustrates an embodiment of the inventive pipe wrench 100 being driven by a pneumatic ratchet 1000. The wrench 100 is being used to turn chrome plated pipe 1002 into a chrome plated fitting 1004. The purpose of FIG. 10 is to demonstrate alternative methods of turning the pipe wrench 100.

FIG. 11 illustrates an embodiment of the inventive pipe wrench that is constructed with a common wrench socket 1102. The drive shaft 1100 is driven by a common wrench socket 1102 and has gripping shells 1104 and 1106 captured by a retaining cap 1108. The drive shaft 1100 can be locked into the wrench socket 1102 by various means including adhesive, press fitting, brasing, soldering, etc.

FIG. 12 illustrates an alternative embodiment similar to the embodiment illustrated in FIG. 11. In a manner similar to FIG. 11, FIG. 12 illustrates a single staged portion of the gripping shells. A socket drive 1202 engages the drive shaft 1200 and may be retained in the drive socket 1202 in various ways including friction fitting, O-ring fitting, as described in FIG. 30, or any desirable manner. Shells 1204 and 1206 have shoulders 1210 and 1212 respectively that engage the butt end of the pipe, as described above. As shown in FIG. 12, the gap between the lips 1218, 1220 and the inner surface 1222 of the cap is sufficient to allow the cam to have sufficient throw to completely rotate without breaking the cap 1208. In addition, the surface between the cap and the lips 1218, 1220 should have low friction to allow the shells 1204, 1206 to easily rotate against the cap 1208.

Similarly, the lips 1214, 1216 have a gap that is defined by the drive socket 1202 that is substantially equal to the gap between the lips 1218, 1220 and the cap 1208. Also, the surface between the lips 1214, 1216 and the drive shaft 1200 is a low friction surface to, again, allow the shells to rotate freely. The shoulder surfaces 1210, 1212 may be desirable to be made as high friction surfaces, in the manner described herein, so that the butt end of the nipple will engage and rotate the shells 1204, 1206 with respect to the drive shaft 1200.

Figure 13:
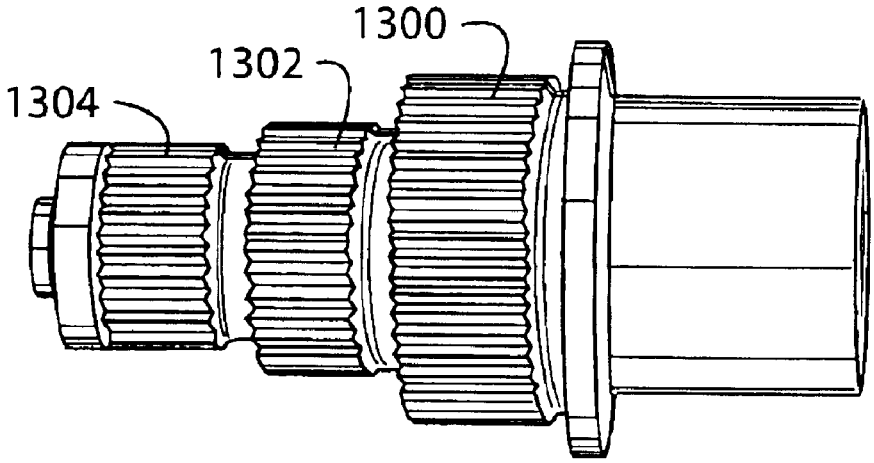
FIG. 13 is an illustration of a multi-stage wrench in accordance with the present invention that uses splines around the entire gripping surface of the shells.
Figure 26:
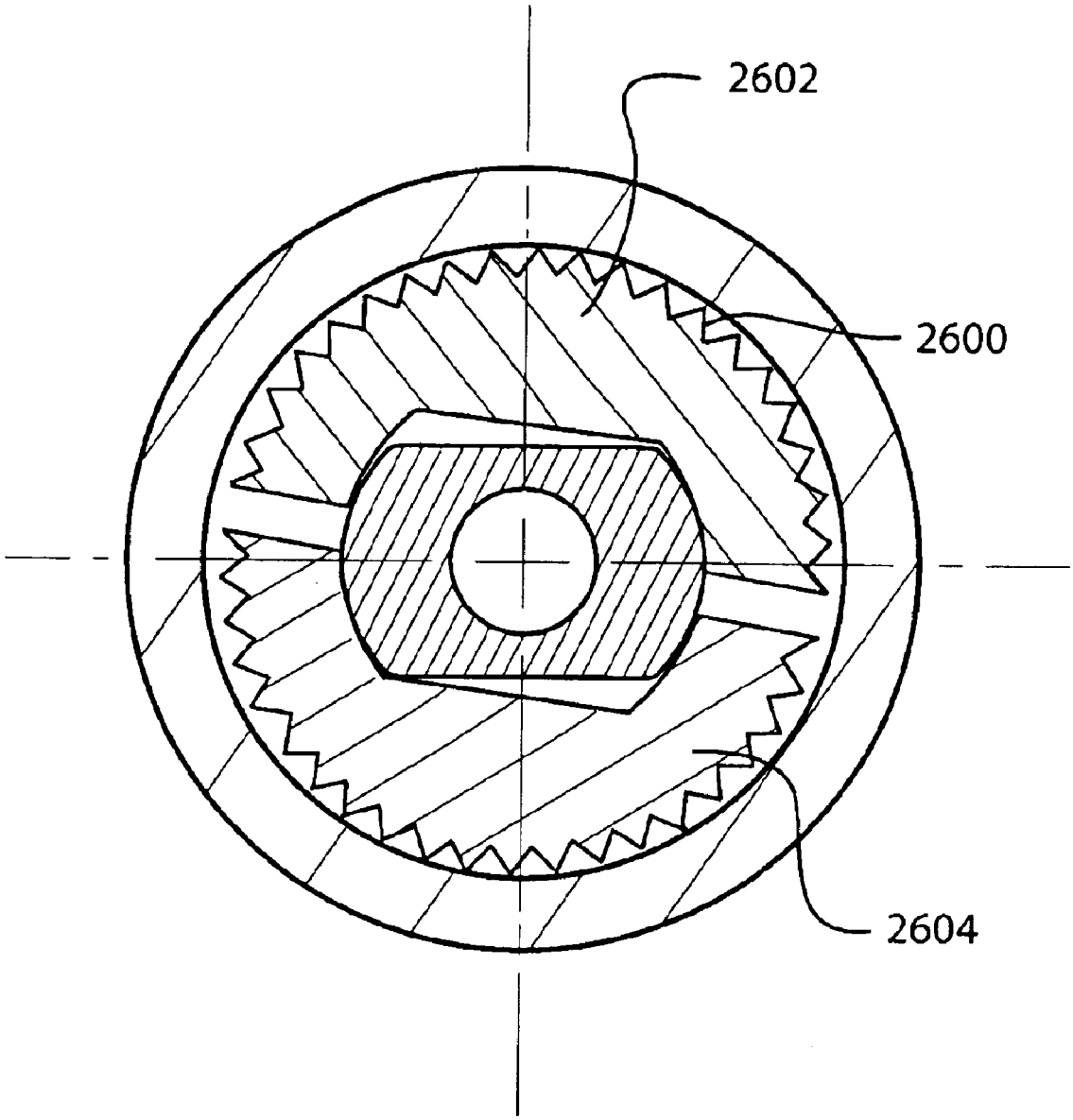
FIG. 26 is a cut-away view of the wrench of the present invention in an engaged position illustrating the manner in which splines may cover the entire gripping surface of the shells.

FIG. 13 is an illustration in which the splines 1300, 1302, 1304 extend around the entire surface of each of the shells of the device. This feature is also shown in FIG. 26.

Figure 14:
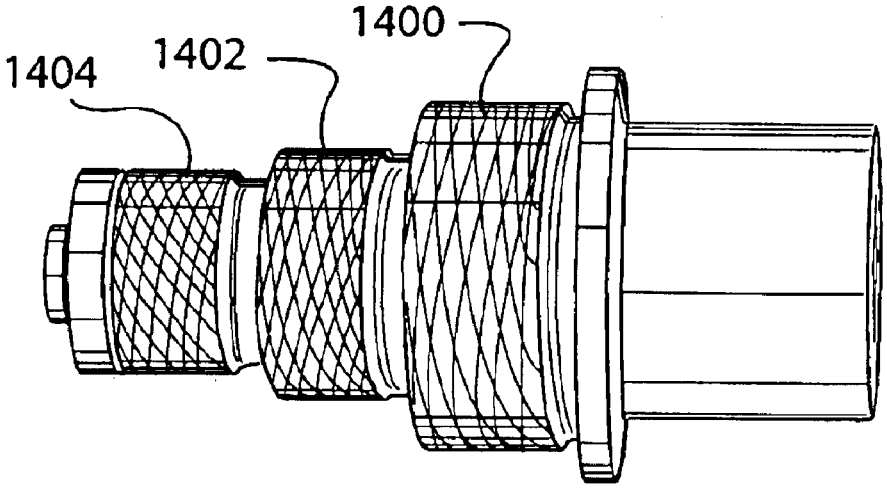
FIG. 14 illustrates a multi-stage wrench that uses rough surfaces around the entire periphery of the shells.

FIG. 14 illustrates rough surfaces 1400, 1402 and 1404 that are formed into the face of the shells, as opposed to using the splined surfaces illustrated in FIG. 13. The frictional surfaces 1400, 1402 and 1404 can be diamond grip surfaces, knurled surfaces, cut surfaces, or any desired surface to create friction between the inner surface of the pipe and the shells. In some instances, softer metal materials or rubber or other coatings may be desired to be placed on the gripping shells. Further, the pipe may be made of a material that is a soft gripping material so that smooth or only slightly rough surfaces are needed to engage the inner surface of the pipe.

Figure 15:
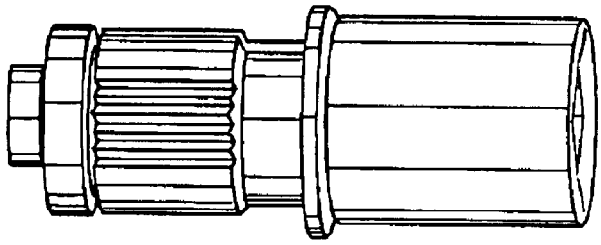
FIGS. 15, 16, 17 and 18 illustrate single stage pipe wrench in accordance with the present invention of different sizes.
Figure 16:
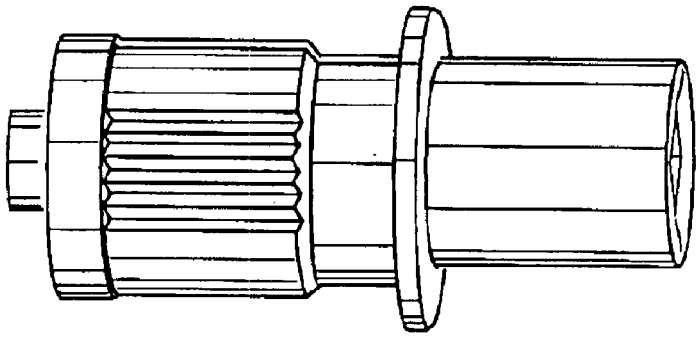
Figure 17:
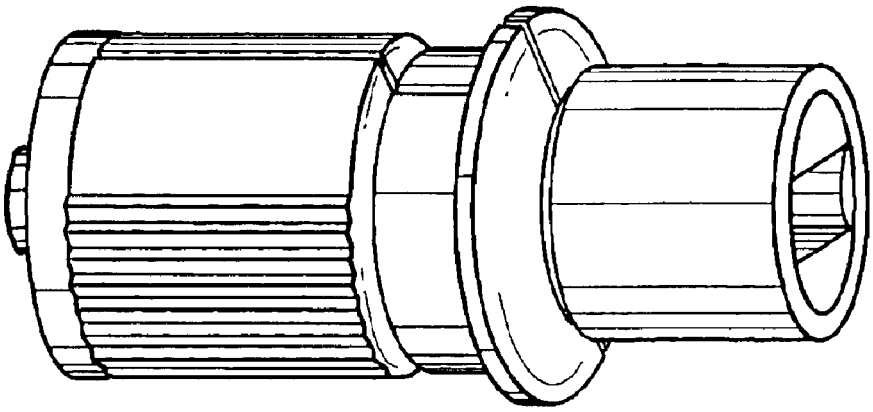
Figure 18:
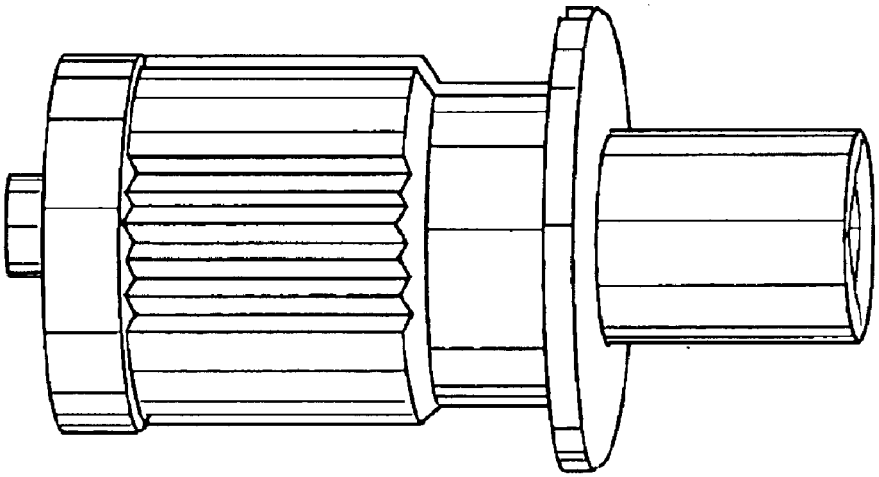

FIGS. 15, 16, 17 and 18 illustrate four different single stage devices that employ various features of the present invention. For example, FIG. 15 illustrates a half-inch device, while FIG. 16 illustrates a five-eighths inch device. FIG. 17 illustrates a three-quarter inch device, while FIG. 18 illustrates a one-inch device. These figures illustrate that various size units may be provided to customers as single staged units and multi-stage units in a complete set. For example, there may be applications in which a multi-stage unit cannot be used because of the clearance required. Hence, single-stage units must be employed.

Figure 19:
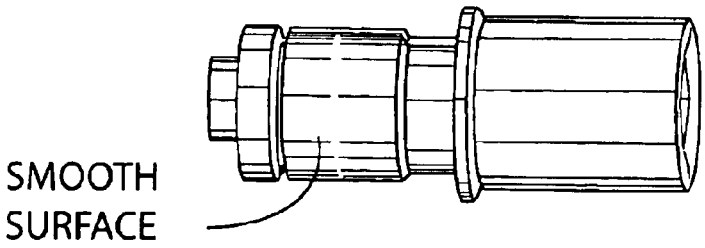
FIGS. 19, 20, 21 and 22 illustrate single stage wrenches in accordance with the present invention having various types of gripping surfaces.
Figure 20:
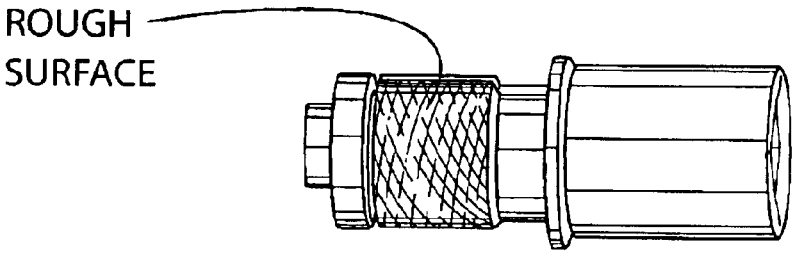
Figure 21:
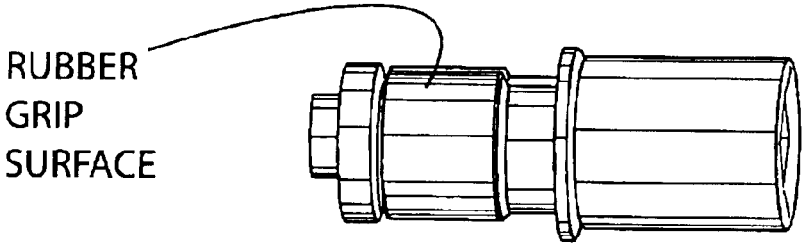
Figure 22:
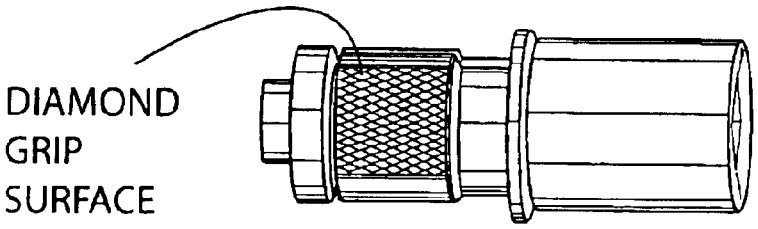

FIGS. 19, 20, 21 and 22 illustrate various types of surfaces that can be used on the single-stage devices. For example, FIG. 19 illustrates that a smooth surface can be used on the shells. This may be desirable for certain applications where soft materials are being employed for the pipe. As illustrated in FIG. 20, a rough surface can be formed such a knurled surface, a sand surface, a cut surface, or any other desired type of surface. FIG. 20 illustrates that a rubber coating, or other type of coating, can be applied to the surface of the shell to grip the pipe. FIG. 22 illustrates a diamond grip surface 2200 for gripping the inner surface of the pipe.

Figure 23:
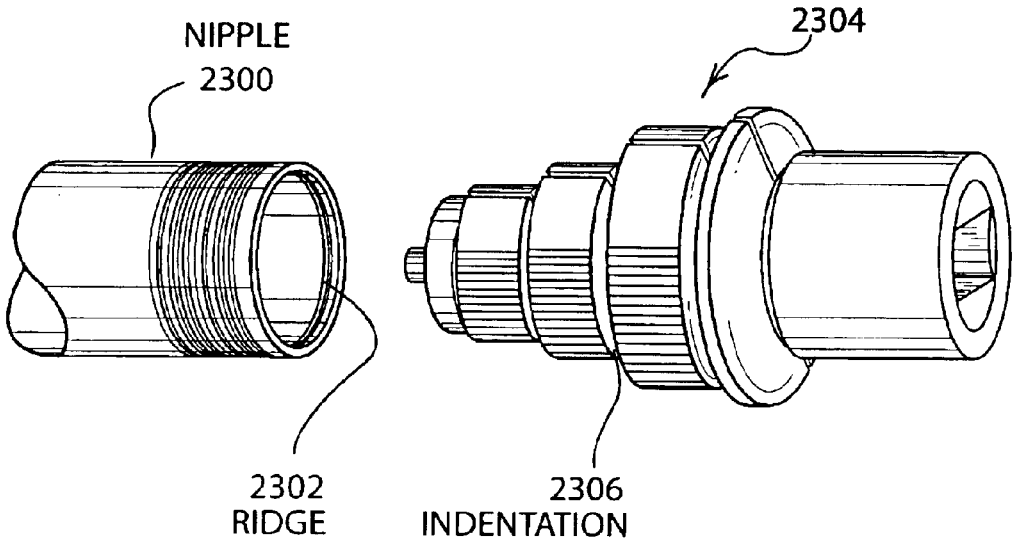
FIG. 23 is a perspective view illustrating the indentations in a multi-stage pipe wrench in accordance with the present invention that account for ridges on cheaply built nipples.

FIG. 23 illustrates another advantageous feature that can be employed with respect to the present invention. As shown in FIG. 23, a nipple 2300 may be a low quality nipple in which a ridge 2302 is formed that protrudes inwardly as a result of the formation process of the nipple 2300. The wrench 2300, as disclosed above, has shells that have an indentation 2306 that accommodate the ridge 2302, as more fully illustrated in FIG. 24.

Figure 24:
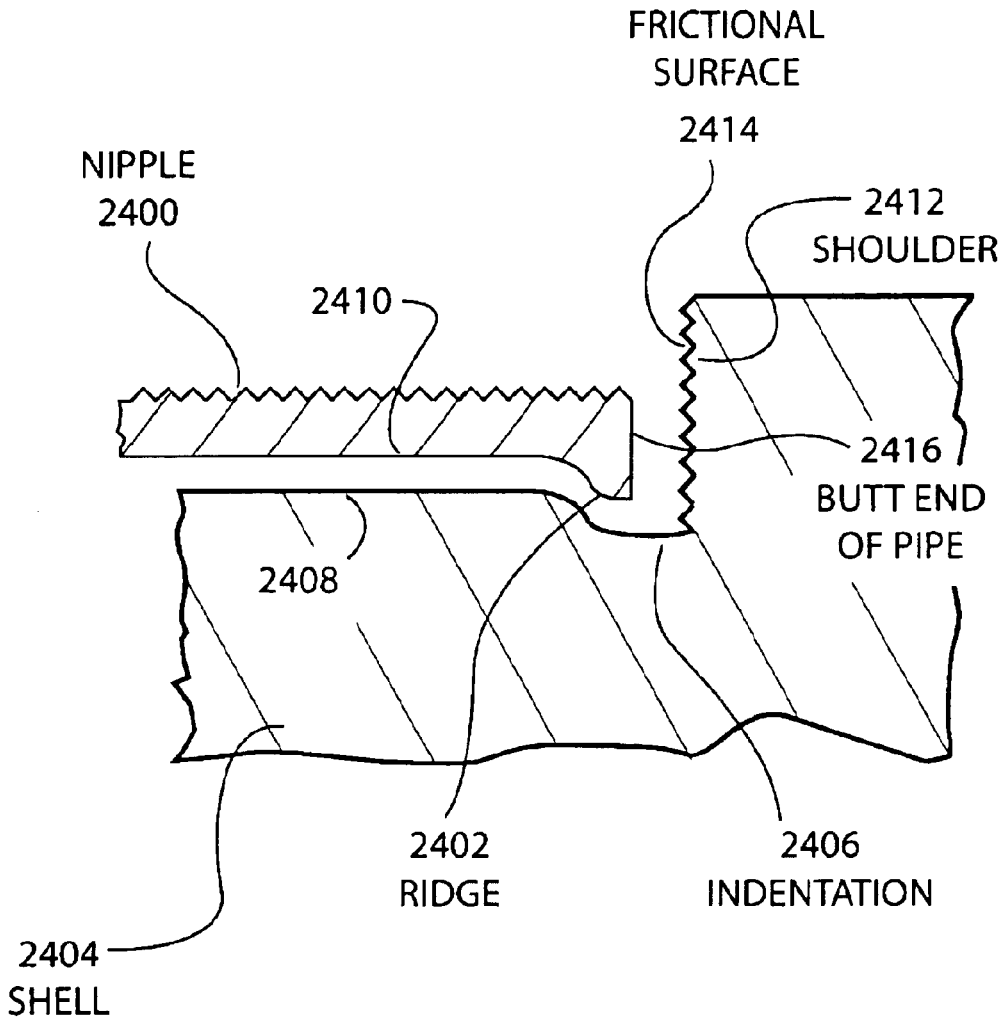
FIG. 24 is a cut-away view illustrating the manner in which indentations in the shells account for ridges formed in cheaply formed nipples.

FIG. 24 is a cross sectional view of a nipple 2400 that is engaged by a shell 2404. As shown in FIG. 24, the nipple 2400 is an inexpensive nipple that has a ridge 2402 that protrudes inwardly towards the inner diameter of the nipple 2400. The protrusion or ridge 2402 is generated through low quality production methods for forming the nipple 2400. This has become somewhat commonplace in inexpensive nipples. The shell 2404 has an indentation 2406 to accommodate the protrusion 2402. In this manner, the gripping surface 2408 of the shell 2404 can engage the inner surface 2410 along an extended region without interference from the ridge 2402. FIG. 24 also illustrates the frictional surface 2414 that is formed in the shoulder 2412 of the shell 2404. Again, the butt end 2416 of the pipe is engaged along the shoulder 2412 as the wrench is inserted into the nipple to cause the shell 2404 to rotate with the nipple 2400 thereby causing the drive shaft and the cams to open the shell 2404 and engage the inner surface 2410 of the nipple 2400 by the surface 2408 of the shell 2404.

Figure 25:
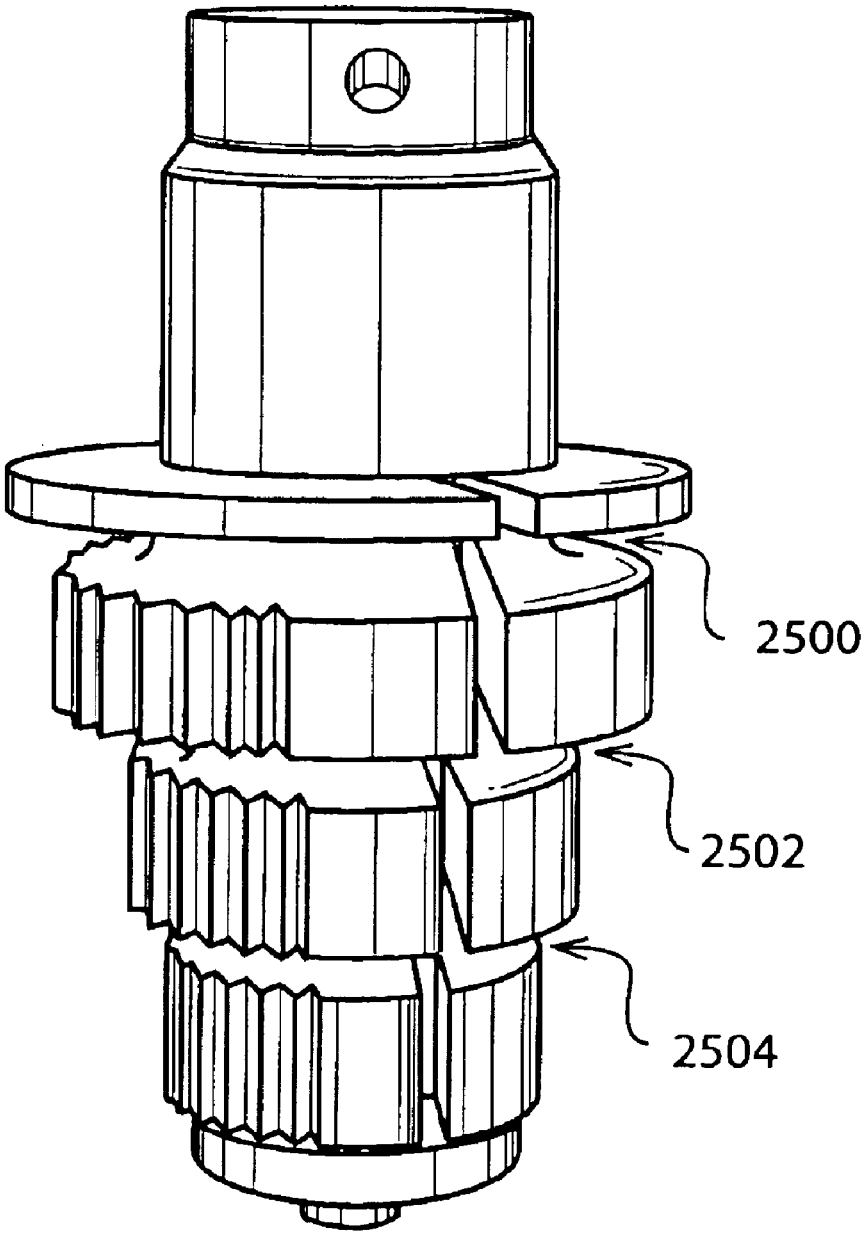
FIG. 25 is a perspective view of a multi-stage wrench in accordance with the present invention illustrating the indentation portions.

FIG. 25 is a further illustration of a multistage wrench having indentations 2500, 2502 and 2504 for each stage to accommodate the ridges that may be formed on the pipe butt end.

FIG. 26 is similar to FIG. 4 but illustrates that the splined surfaces 2600 can be formed along the entire surface of the shells 2602 and 2604. This may assist in engaging the inner surface of the pipe.

Figure 27:
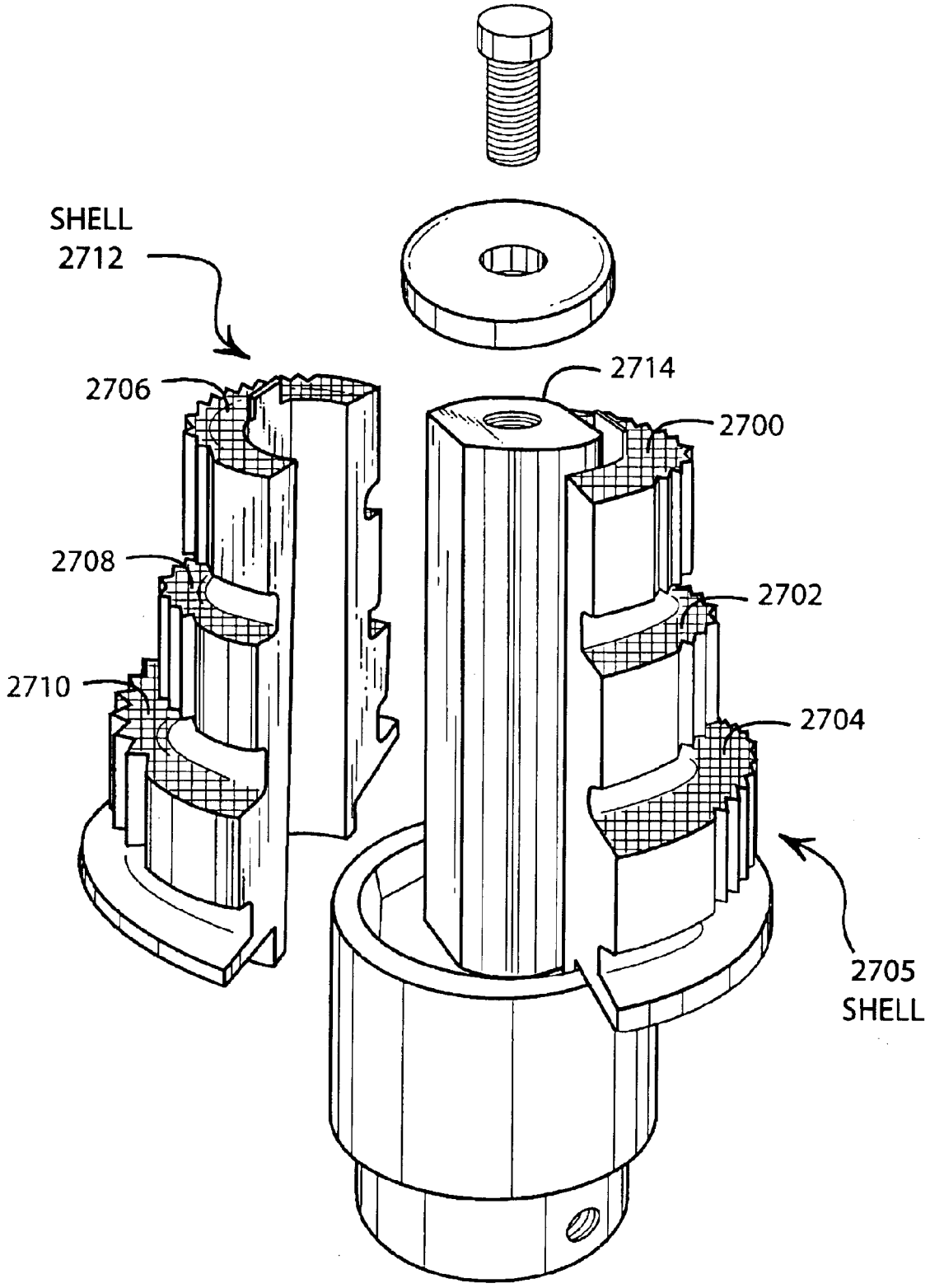
FIG. 27 is a partially exploded view of the wrench of the present invention that employs a frictional surface on the shoulders of each of the gripping surfaces.

FIG. 27 is an exploded view diagram of a multistage wrench, in accordance with the present invention, that illustrates the frictional surfaces 2700, 2702 and 2704 on the shoulders of shell 2705, and frictional surfaces 2706, 2708 and 2710 on the shoulders of shell 2712. Again, these frictional surfaces engage the butt end of the pipe when the wrench is inserted into the pipe and assists in causing the shells to rotate with the pipe so that the drive shaft 2714 can rotate with respect to the shells 2705, 2712. FIG. 27 also illustrates the indentations between each of the engaging surfaces of the multistage device.

FIG. 28 illustrates another embodiment of the invention in which two pipes 2800, 2802 can be aligned to form a butt weld 2804. As shown in FIG. 28, the alignment device 2810 is inserted in the pipes 2800, 2802 so that engaging surfaces of the shell expand and align the pipes 2800, 2802 in proper orientation so that the butt ends are aligned. In this fashion, a butt weld 2804 can be made as a result of the proper alignment of the two pipes 2800, 2802. The alignment device 2810 includes a socket drive 2812 that is engaged by an extension 2814. In aligning the pipes, the alignment device is inserted using the extension 2814 until it is aligned with the gap between the two pipes 2800, 2802. The pipes 2800, 2802 are then forced against each other so that the butt ends are aligned. At the same time, the extension 2814 is rotated in either direction to expand the shells 2806, 2808 so that the shells engage the inner surfaces of both of the pipes 2800, 2802 and align those pipes for butt-welding.

Figure 29:
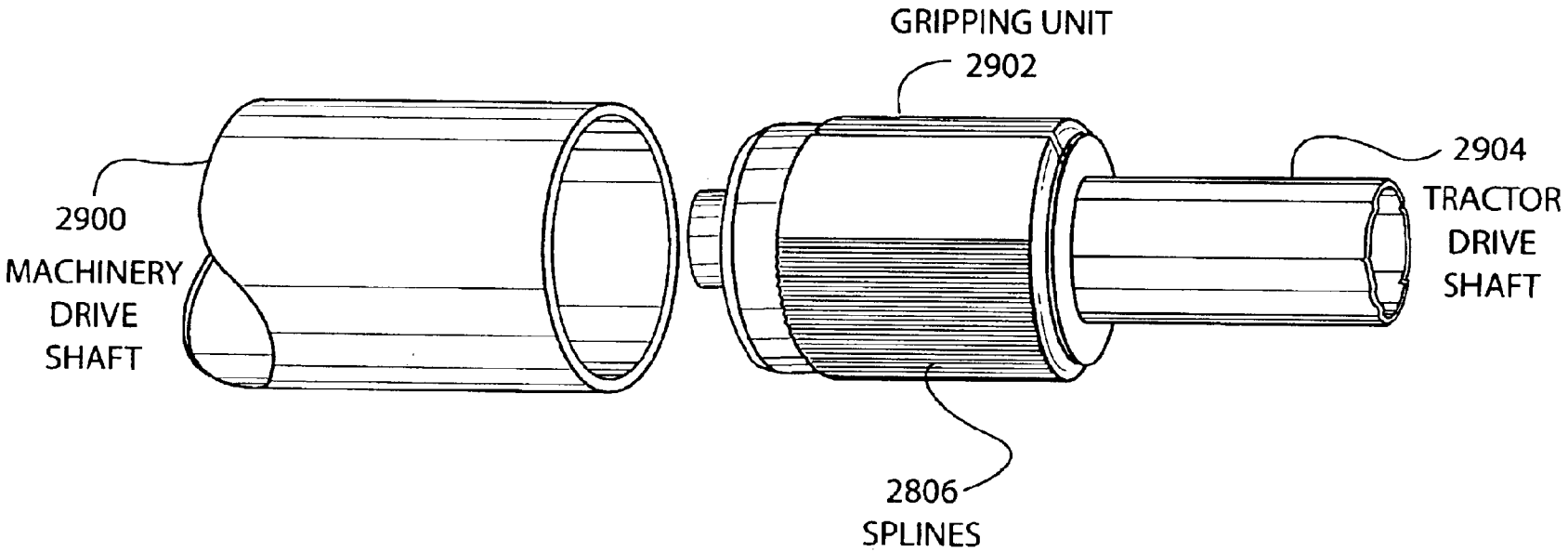
FIG. 29 is another alternative embodiment of the present invention illustrating the manner in which the present invention may be used as a power-coupling unit.

FIG. 29 illustrates another application of the concepts of the present invention. As shown in FIG. 29, a machinery drive shaft 2900 may have an opening to engage the gripping unit 2902. The gripping unit 2902 may be attached to a drive shaft, such as a tractor drive shaft 2904. The gripping unit 2902 operates in the same fashion as described above. The machinery drive shaft 2900 may also have splines such as the splines 2806 for effective engagement between the machinery drive shaft 2900 and the gripping unit 2902. The advantage of the device illustrated in FIG. 29 is that power can be coupled between drive shafts for machinery and power units in a simple and easy fashion that allows the drive shaft to rotate in either direction and to be engaged and disengaged in a simple and easy fashion.

FIG. 30 illustrates the manner in which a drive socket 3000 can accommodate a separate drive shaft 3010 so that the drive shaft 3010 is engaged in the socket 3000 in a removable manner. As shown in FIG. 30, indentations 3002 are formed along each of the inner surfaces of the socket 3000. The ring 3004 is pushed into the gaps between plates 3006, 3008. Plates 3006, 3008 are formed to fit within the opening of the socket 3000. The O-ring 3004 extrudes partially from the flat surfaces of the plates 3006, 3008 and engages the indentations 3002 so that the drive shaft unit 3010 is removably engaged within the socket 3000. This is advantageous in that if a drive shaft 3010 is broken it can be easily dismantled from the socket 3000 and replaced without replacing the entire unit including the socket portion 3000. The drive shaft and other parts associated with the drive shaft, such as the plates 3006 and 3008, may be tempered to cause slow failure of the drive shaft 3010. This prevents the user from possibly breaking fingers or hands during the use of the device. The replaceable drive shaft 3010 can be easily disconnected from the socket 3000 as a replaceable part.

Figure 31:
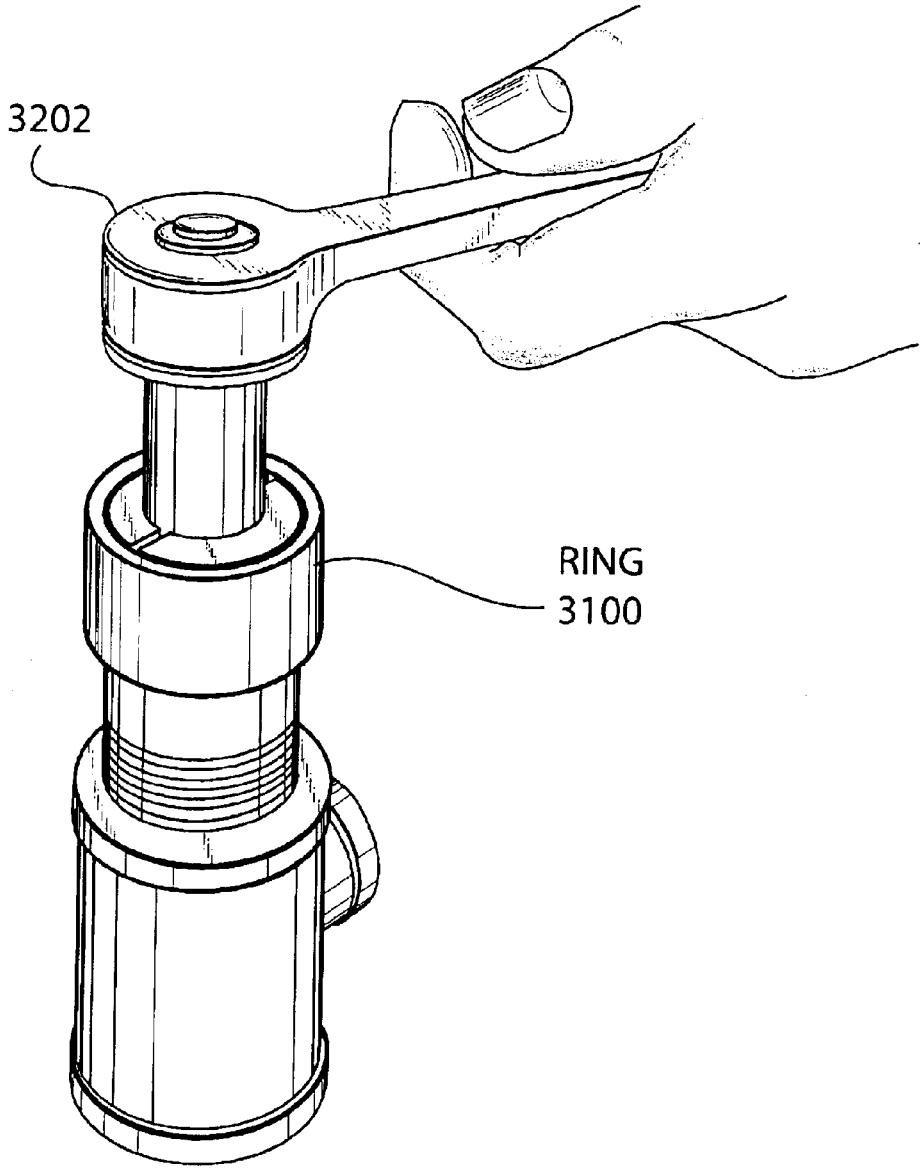
FIG. 31 is a perspective view illustrating the manner in which a ring may be employed with the present invention.

FIG. 31 illustrates a ring 3100 that can be used with the present invention. Ring 3100 is a separate ring that has an internal opening that will fit around the outer diameter of the pipe. The ring 3100 provides structural rigidity for the pipe and will allow pipes such as thin wall pipes or pipes that have been corroded to maintain a round shape while the wrench of the present invention is utilized. In other words, the ring 3100 prevents the pipe from falling apart or taking on an oval shape while the wrench is being used which may detract from the effectiveness of the wrench of the present invention.

Figure 32:
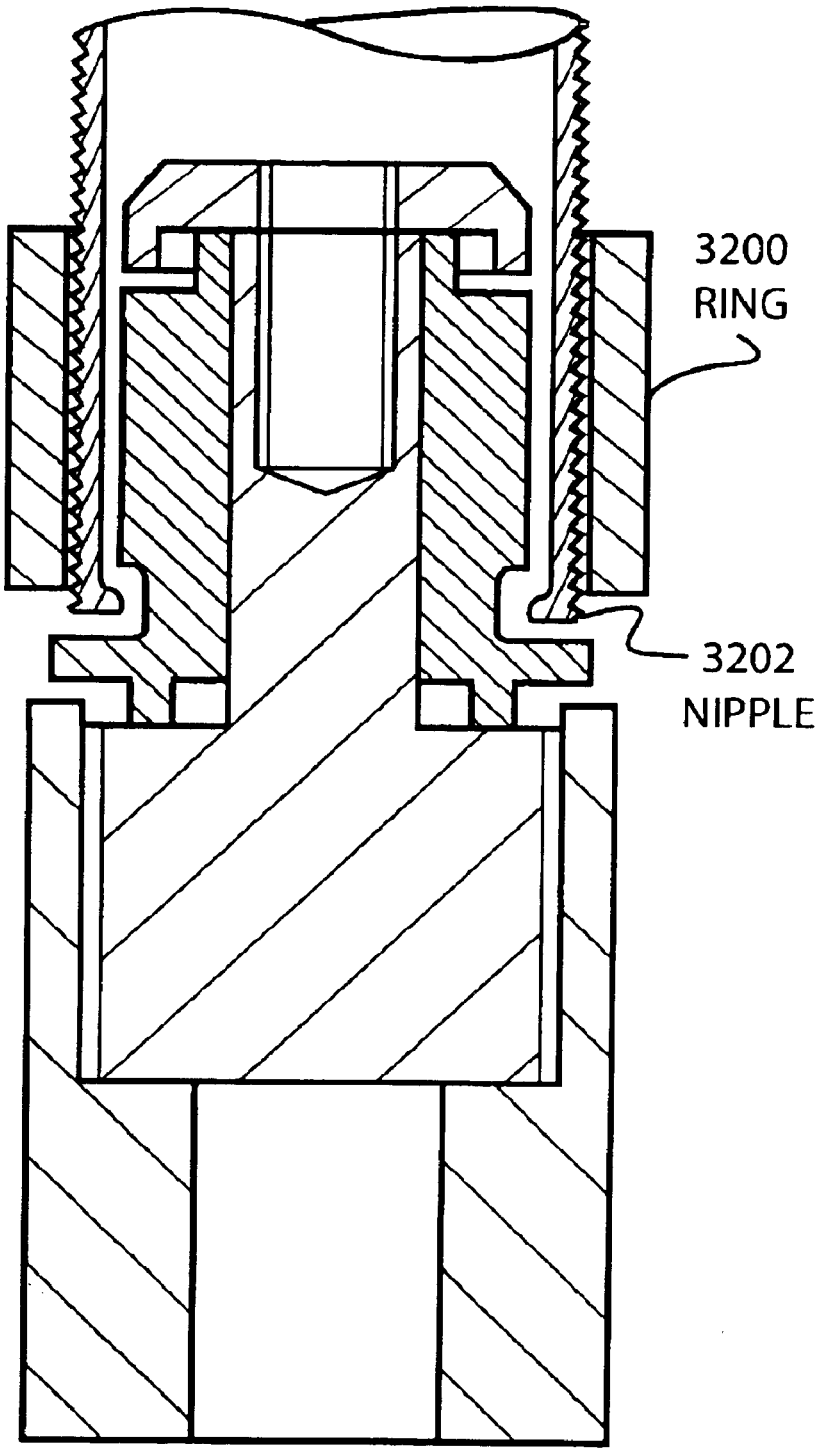
FIG. 32 is a cut-away view illustrating the manner in which a ring may be used in conjunction with the present invention.

FIG. 32 is a cut away illustration for the manner in which the ring 3200 may be employed. As shown in FIG. 32, the ring 3200 is placed over the outer surface of the nipple 3202. The ring 3200 fits over the outer surface of the nipple 3202 which has a specified outer diameter. The ring 3200 is formed of a material having a thickness to provide sufficient rigidity to prevent the nipple 3202 from ovaling which could prevent the wrench from engaging and turning the nipple 3202. In other words, if the nipple 3202 obtains an oval shape the drive shaft may not have sufficient throw to cause the nipple to turn and pass over the center point of the drive shaft preventing the wrench of the present invention from turning the nipple 3202. Ring 3200 also provides sufficient structural rigidity to allow corroded nipples or pipes 3202 from falling apart and preventing the wrench from turning the nipple. The ring 3200 may comprise different sized rings for different sized nipples and may be carried as a separate device to assist the user, as necessary.

Figure 33:
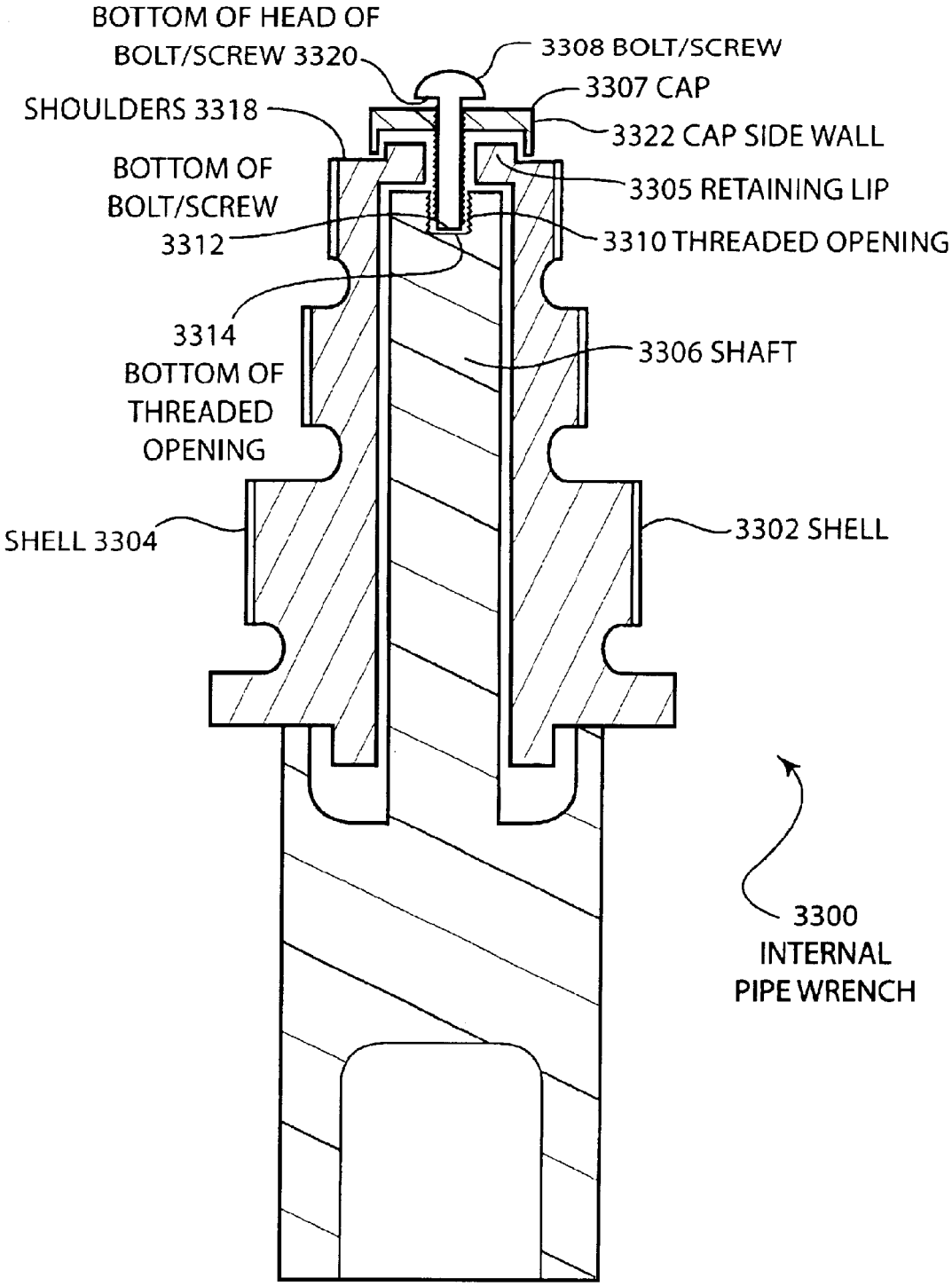
FIG. 33 is a cross-sectional view of another embodiment of the invention.

FIG. 33 illustrates a cross-sectional view, that is similar to FIG. 9, but that shows an alternative design for the shells and retaining cap for the internal pipe wrench 3300. As show in FIG. 33, shells 3302 and 3304 are constructed so that retaining lip 3305 engages the shaft 3306 and the cap 3307 in a different fashion than as shown in FIG. 9. As shown in FIG. 33, the cap 3307 is attached to the internal pipe wrench 3300 by way of a bolt or screw 3308. The bolt or screw is threaded into a threaded opening 3310 in the shaft 3306. The threaded opening 3310 has a predetermined depth such that the bottom of the bolt/screw 3312 bottoms out on the bottom of the threaded opening 3314 at a predetermined depth. The cap 3307 then has a certain amount of vertical play between the bottom of the cap 3316 and shoulders 3318 of the shells 3302, 3304. The bottom of the head of the bolt screw 3320 engages the upper surface of the cap 3307 to provide the amount of vertical play, as shown in FIG. 33, between the bottom of the cap 3316 and the shoulders 3318. This vertical play allows the shells 3302, 3304 to easily rotate with respect to the shaft 3306. The amount of vertical play, together with the length of the sidewalls of the cap 3307 prevent the shells from disengaging from the internal pipe wrench 3300 when the bolt/screw 3308 is tightened into position on the shaft 3306. The retaining lip 3305 can be machined or cast into the shells 3302, 3304 and have the advantage of providing a very strong structure for retaining the shells 3302, 3304 on the internal pipe wrench 3300. In other words, the retaining lip 3305 cannot be easily broken when the internal pipe wrench 3300 is in use. The throw provided by the cam surface of the shaft 3306 may either allow the shaft 3306 to completely rotate without causing structural failure of either the retaining lip 3305 or the cap sidewall 3322, or may be designed for failure of the cap sidewall 3322 in certain instances. For example, it may be desirable to maintain a very small horizontal gap between the retaining lip 3305 and the cap sidewall 3322. The internal diameter of pipes on which the internal pipe wrench 3300 may be used may have tight tolerances and require only a minimum amount of throw before engagement of the internal surface of the pipe. Hence, it may be advantageous to have close tolerances especially where insertion of the tool in an easy manner, such as in automated assembly, is desirable. Otherwise, the cap 3307 is designed to provide sufficient tolerance to allow the shaft 3306 to completely rotate without causing failure of the cap sidewall 3322, or the retaining lip 3305.

Figure 34:
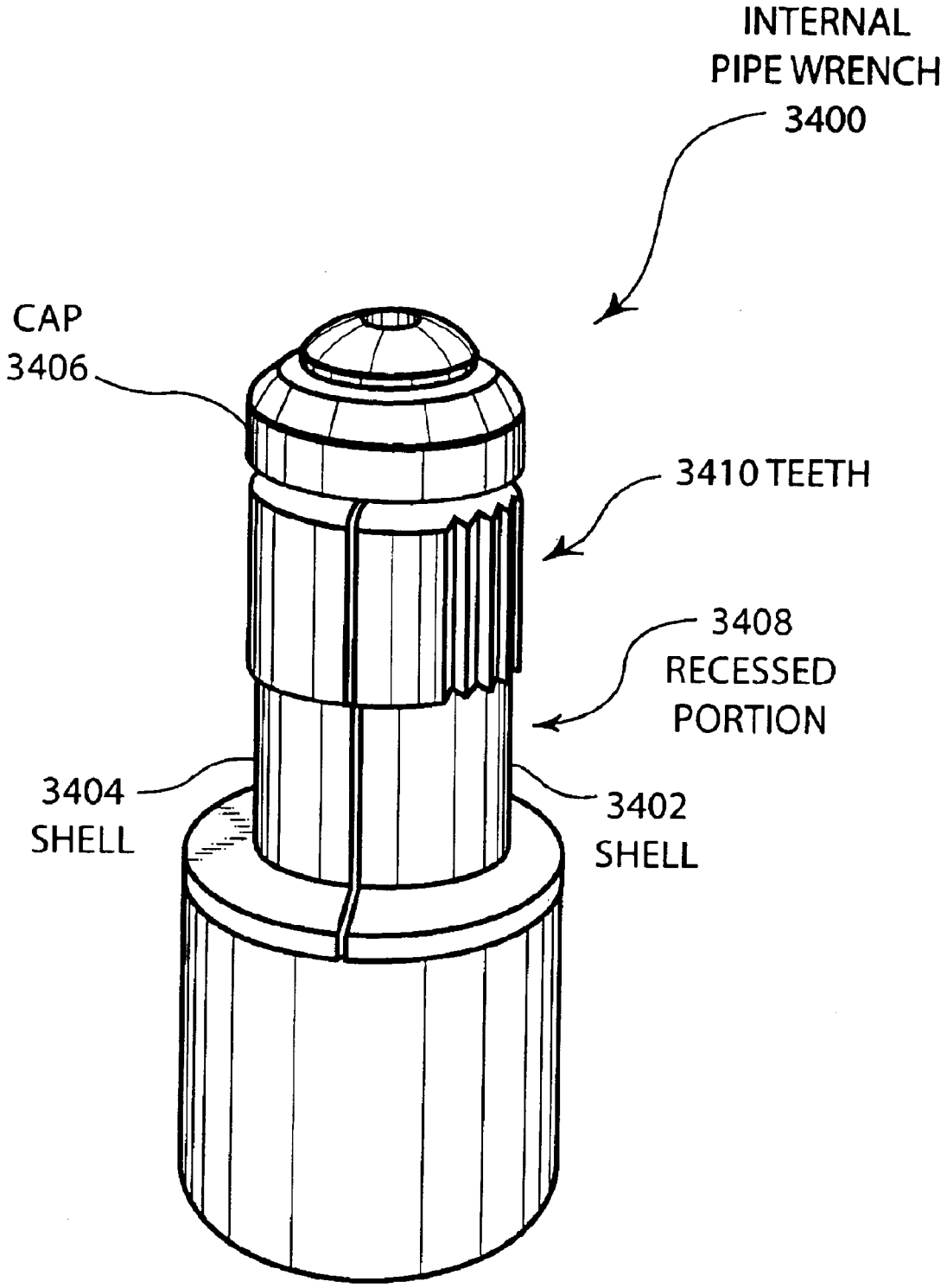
FIGS. 34–37 are perspective views of another embodiment of the invention illustrating the manner in which a pipe can be engaged beyond a threaded portion to prevent ovaling of the pipe.

FIG. 34 is a perspective view of another embodiment of an internal pipe wrench 3400. The internal pipe wrench 3400 has shells 3402 and 3404, or may include three or more shells as disclosed above. The shells 3402, 3404 include a recessed portion 3408 which is slightly recessed from the teeth 3410 disposed on the shells 3402, 3404. As disclosed above, a cap 3406 is used to retain the shells 3402, 3204 on the internal pipe wrench 3400. The cap 3406 also has a diameter that is slightly less than the diameter of the teeth when the shells 3402, 3404 are in the closed position, as shown in FIG. 34. The cap 3406 can also be equal to or even slightly larger than the diameter of the shells at the portion indicated by teeth 3410.

Figure 35:
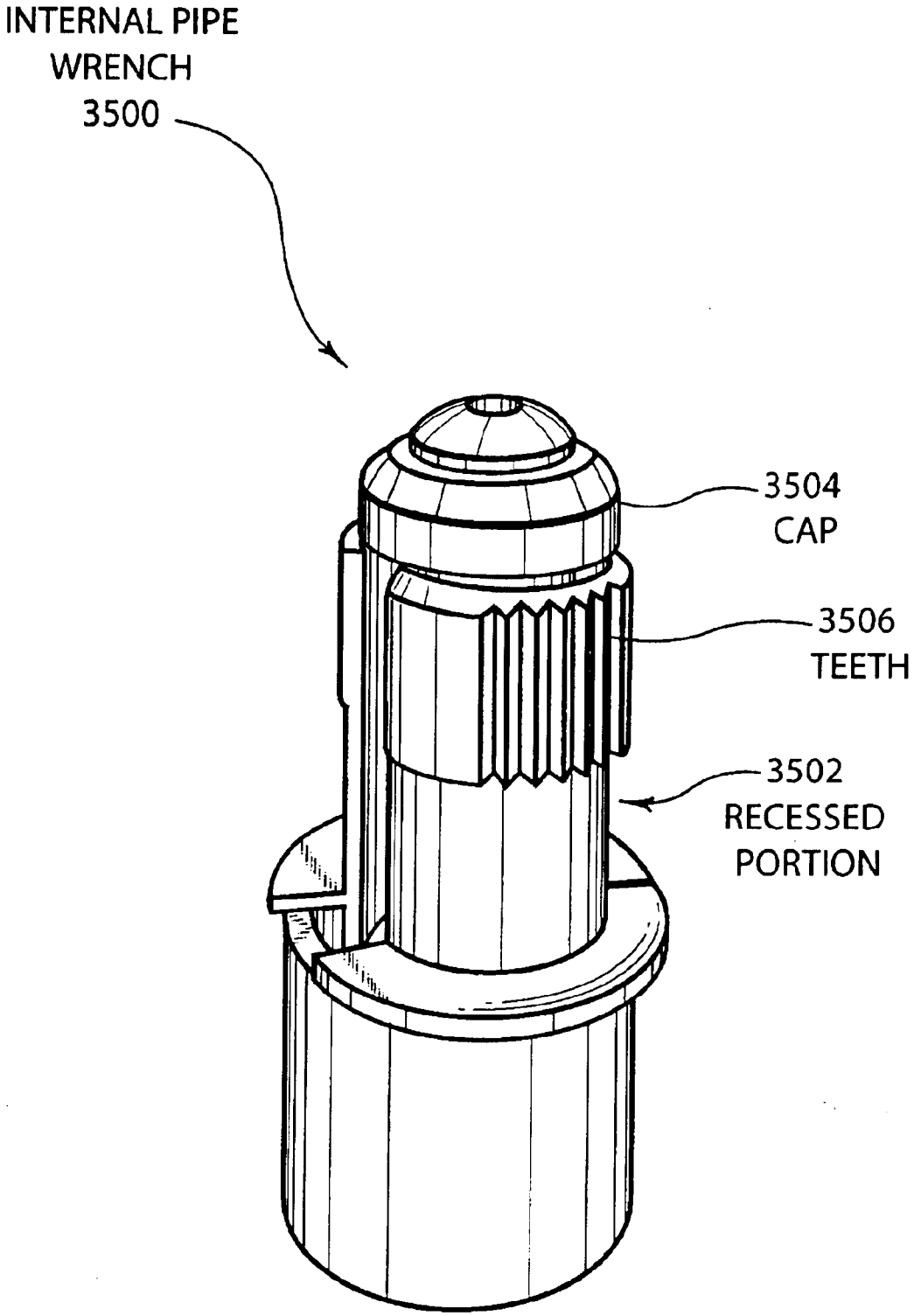

FIG. 35 is a perspective view of an internal pipe wrench 3500 in an open position. As shown, the teeth 3506 extend beyond the cap 3504 and, of course, beyond the recessed portion 3502. In this fashion, the teeth 3506 can engage the internal surface of a pipe.

Figure 36:
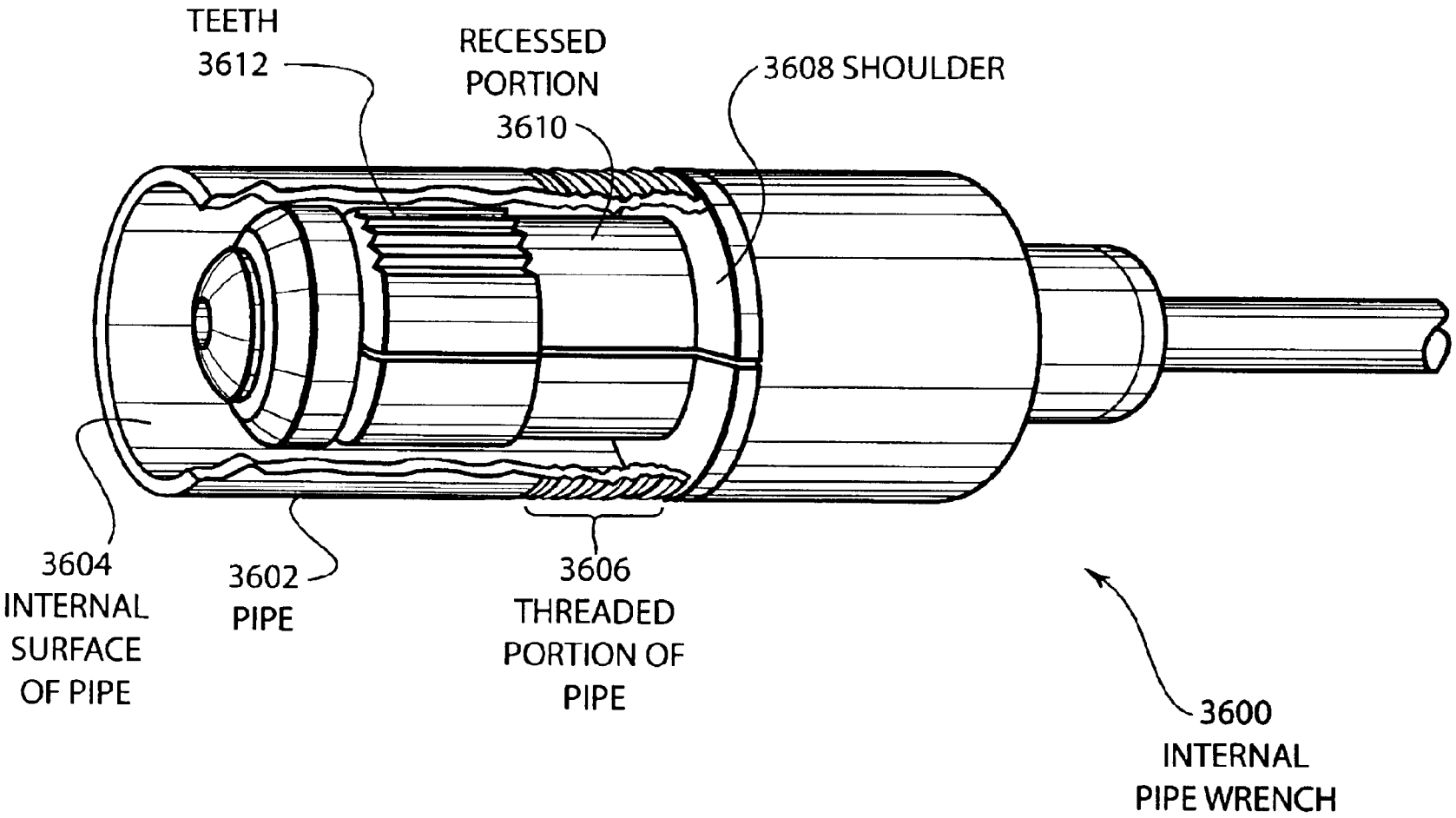

FIG. 36 is a cut-away perspective view of an internal pipe wrench 3600 disposed in a pipe 3602. As shown in FIG. 36, the recessed portion 3610 is sufficiently long to allow the teeth 3612 engage the internal surface of the pipe 3604 beyond the threaded portion of the pipe 3606. It has been found through testing that removal of external portions of the pipe during the threading process weakens the pipe which can cause the pipe 3602 to oval if sufficient force is applied by an internal pipe wrench when the force is applied adjacent the threaded portion of the pipe 3606. In the embodiment illustrated in FIG. 36, the teeth 3612 engage the internal surface 3604 of the pipe 3602 beyond the threaded portion of the pipe 3606 such that a greater force can be applied by the internal pipe wrench 3600 without ovaling the pipe. Of course, additional shells, such as shown in FIG. 6, and various cam configurations can be used to more evenly distribute the force about the pipe which also assists in preventing ovaling.

Figure 37:
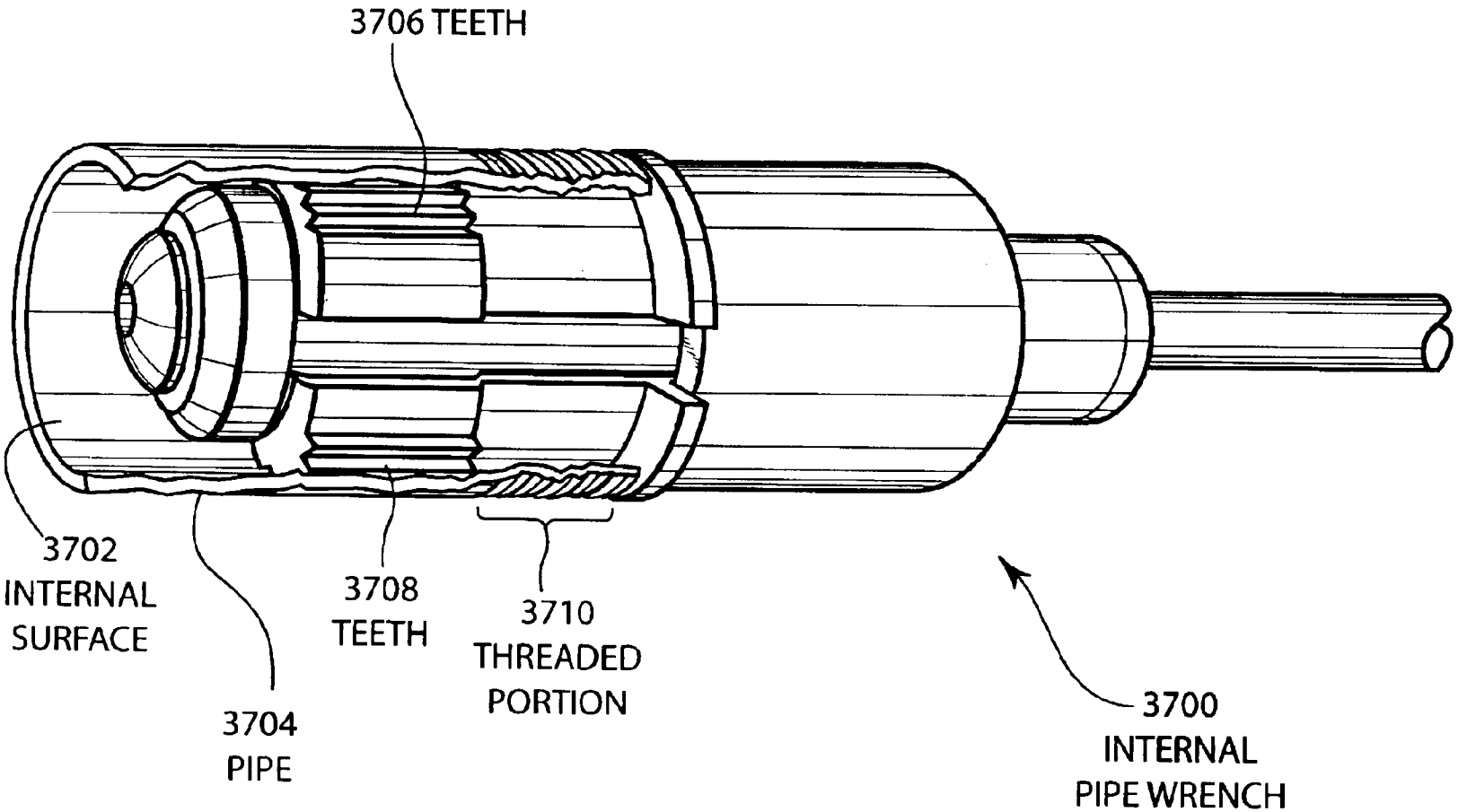
Figure 38:
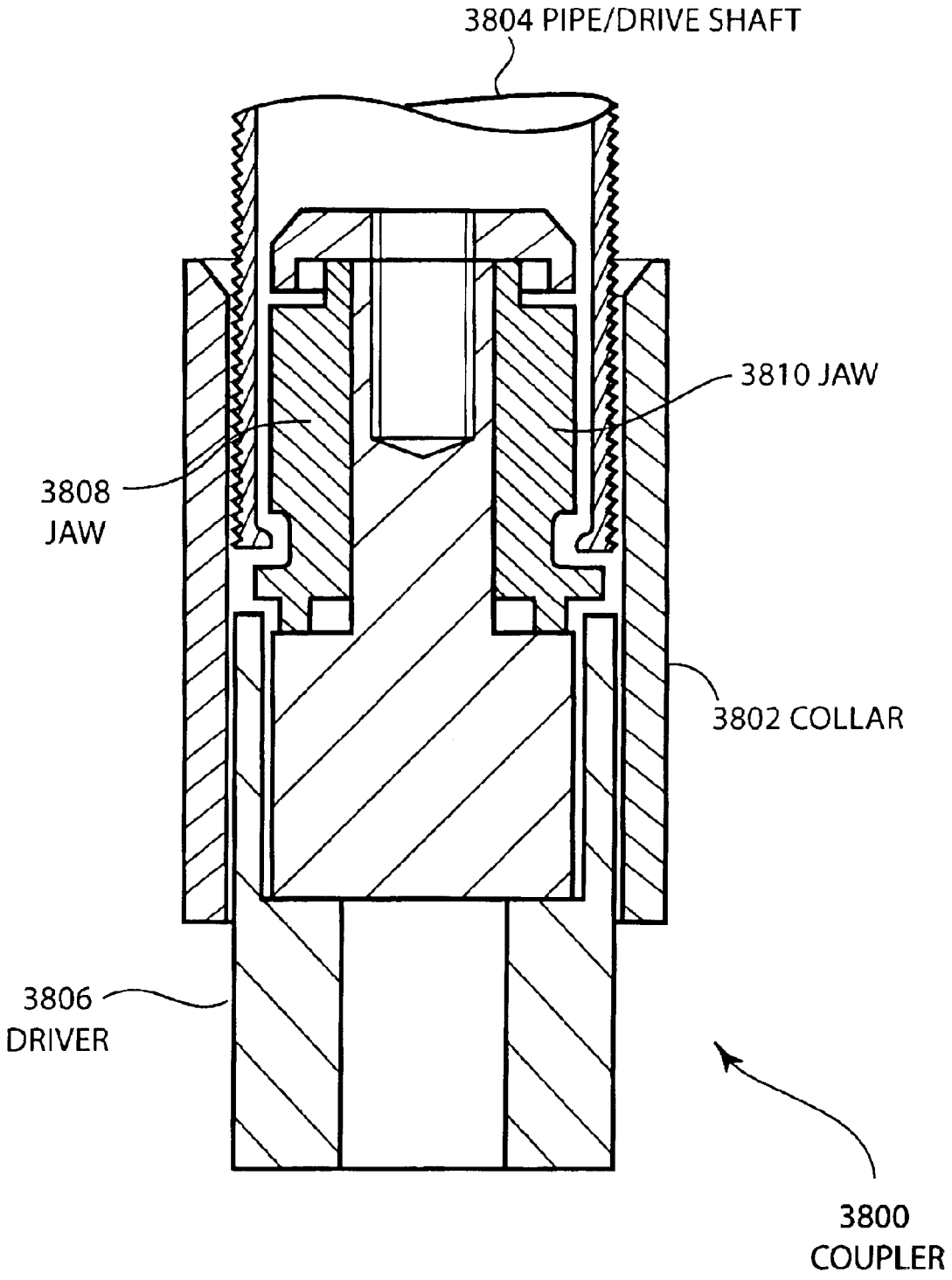
FIG. 38 is a cross-sectional view of another embodiment of the invention that includes a collar for preventing ovaling.

FIG. 37 illustrates the internal pipe wrench 3700 in an expanded orientation such that the teeth 3706, 3708 engage the internal surface 3702 of the pipe 3704 beyond the threaded portion of 3710 of the pipe 3704. FIG. 38 is a cross-sectional view of another embodiment of a coupler 3800. As shown in FIG. 38, a driver similar to that shown in FIG. 32 and FIG. 12 is shown. As indicated above, the coupler 3800 can be used as an internal pipe wrench, a coupler for driving a driveshaft, or any other desired use for coupling energy to a pipe, driveshaft or other similar device. As show in FIG. 38, a collar 3802 is coupled to the driver 3806 of the coupler 3800. The collar 3802 can be press fit onto the body of the driver 3806, or otherwise attached or connected in any desired fashion, such as by welding, brasing, gluing, soldering, or other forms of connection. The collar 3802 functions in the same manner as ring 3200 of FIG. 32. Pipe/driveshaft, 3804, is inserted between the collar 3802 and the jaws 3808 and 3810 of the coupler 3800. The collar 3802 provides external support for the pipe/driveshaft 3804 to prevent ovaling of the pipe/driveshaft 3804, in a manner similar to ring 3200 of FIG. 32. Rather than providing a separate ring 3200, such as illustrated in FIG. 32, the coupler 3800 provides a collar 3802 that is attached to the driver 3806 to eliminate the need for having a separate ring. Collar 3802 provides sufficient structural rigidity to allow corroded pipes from falling apart and preventing the coupler 3800 from turning a pipe and also prevents the pipe/driveshaft 3804 from ovaling. The inner diameter of the collar 3802 is sized to allow the pipe/driveshaft 3804 to easily slide between the jaws 3808, 3810 and the interior surface of the collar 3802.

Figure 39:
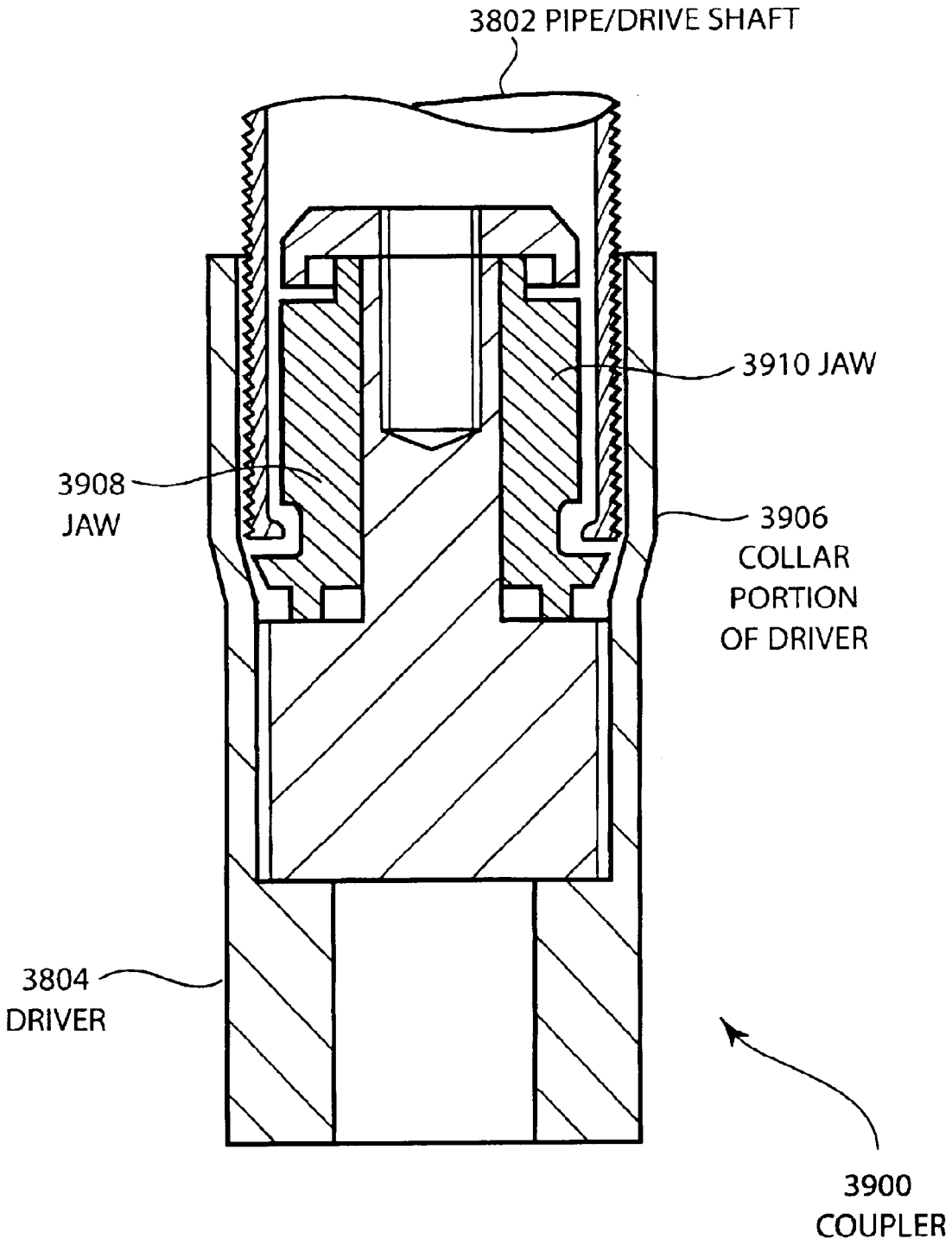
FIG. 39 is a cross-sectional view of another embodiment of the invention that shows a collar portion of the driver that is used to further prevent ovaling of the pipe.

FIG. 39 illustrates another embodiment of a coupler 3900. As shown in FIG. 39, the driver 3904 has a collar portion 3906 that forms part of the structural member of the driver 3804. The collar portion 3906 functions in a manner similar to the collar 3802 of FIG. 38. When a pipe/driveshaft 3902 is placed between the jaws 3908, 3910 and the collar portion 3906, force exerted by the jaws 3908, 3910 will not cause the pipe/driveshaft 3902 to oval because of the structural rigidity provided by the collar portion 3906.

The present invention therefore provides a unique tool that is easy to use and is elegant in design. The tool of the present invention allows the user to save time due to its simplicity and ease of use. The elegance of the design of the present invention allows the present invention to be used in tight places where ordinary pipe wrenches could not be employed. Further, the present invention prevents the marring of the external surface that may occur with the use of a pipe wrench such as the marring of pipe threads or a decorative outer surface of the object being turned. The present invention may also be used to extract broken pipes from a pipe fixtures which may typically occur with plastic pipes. The present invention works in an automatic fashion to apply torque in either a tightening or loosening direction. In other words, the gripping shells or jaws of the present invention engage the inner surface of the pipe without the use of springs or other mechanical devices by virtue of the design of the present invention. More specifically, the jaws of the present invention have a specific tolerance with respect to the inner surface of the pipe that allows the internal jaws to create sufficient friction with the internal surface of the pipe to keep the internal jaws stationary while the cam drives the internal jaws to an open position to transfer the torque to the jaws. The weight of the jaws and the fact that the jaws are unconstrained and allowed to float within the interior diameter of the pipe allows the jaws to engage the internal surface of the pipe and create the necessary friction to allow this process to occur. Further, the shoulders of each of the stages of the shell may engage the end portion of the pipe to further aid in maintaining the shells in a stationary position while the rotational torque of the drive shaft is applied to the shells to cause the shells to open and engage the inner surface of the pipe. This manner, the jaws or gripping shells can "automatically" engage the inner surface of the pipe, without the use of mechanical aids such as springs or other types of devices.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A coupler that is adapted to engage a cylindrical concave internal surface of a cylindrical opening of a torque receptor comprising:

a shaft that rotates around a center axis, said shaft having at least two cam driving surfaces that are spaced substantially equally from said center axis and that are adapted to transmit torque applied to said shaft;

at least two gripping shells having axial end portions and convex external gripping surfaces that have a cylindrical convex profile and that slidingly engage said cylindrical concave internal surface, said gripping shells further including internal cam follower surfaces that are adapted to be engaged by said cam driving surfaces so that torque applied to said shaft is transmitted from said cam driving surfaces to said internal cam follower surfaces so that said center axis of said shaft is substantially aligned with a center axis of said cylindrical opening; and retaining recesses that axially and radially retain said gripping shells on said coupler adjacent said shaft and that allow said gripping shells to move freely in a radial direction and that allow said gripping shells to automatically engage said cylindrical concave internal surface of said cylindrical opening.

2. The coupler of claim 1 wherein said cylindrical opening comprises a cylindrical opening in a drive shaft.

3. The coupler of claim 1 wherein said cylindrical opening comprises a cylindrical opening in a pipe.

4. The coupler of claim 1 wherein said coupler comprises a wrench.

5. The coupler of claim 1 wherein said coupler comprises a drive coupler for a drive shaft.

6. The coupler of claim 1 further comprising a collar connected to said coupler that forms a cylindrical opening between said gripping shells and an interior cylindrical surface of said collar that is adapted to receive said torque receptor and provide structural support for said torque receptor to prevent ovaling of said torque receptor.

7. A wrench for engaging an internal surface of a pipe and turning said pipe in either direction comprising:

a shaft that rotates around a center axis, said shaft having at least two cam driving surfaces that are spaced substantially equally from said center axis for transmitting torque applied to said shaft;

at least two gripping shells having external convex gripping surfaces that are cylindrically shaped, said external convex gripping surfaces disposed on said gripping shells to slidingly engage said cylindrically shaped concave internal surface of said pipe, said gripping shells further including internal cam follower surfaces that are designed to be engaged by at least two cam driving surfaces on said shaft so that said torque applied to said shaft is transmitted to said at least two gripping shells from said center axis in a direction that is substantially transverse to said center axis so that said gripping shells apply force to said cylindrically shaped concave internal surface of said pipe and said center axis of said shaft is substantially aligned with a center axis of said pipe; and a retainer that engages said gripping shells to retain said gripping shells on said wrench adjacent said shaft and allows said shells to freely move, without being biased, in a direction that is transverse to said center axis to automatically open and engage said internal surface of said pipe.

8. The wrench of claim 7 further comprising:

shoulder surfaces disposed on said gripping shells adjacent each external gripping surface that are aligned to engage a butt end of said pipe upon insertion of said wrench into said pipe, said shoulder surfaces causing said gripping shells to at least partially rotate with said pipe when said shaft is rotated around said center axis as a result of said torque applied to said shaft so that said gripping shells expand and engage said internal surface of said pipe.

9. The wrench of claim 8 wherein said shoulder surfaces have a frictional surface formed thereon to increase friction between said butt end of said pipe and said gripping shells to cause said shells to at least partially rotate with said pipe.

10. The wrench of claim 8 further comprising:

a recessed portion disposed in said gripping shells between said gripping surfaces and said shoulder to accommodate ridges that may exist at a butt end of said pipe.

11. The wrench of claim 7 wherein said external gripping surface comprises teeth.

12. The wrench of claim 7 wherein said external gripping surface comprises a hard material.

13. The wrench of claim 7 wherein said external gripping surface comprises a malleable surface.

14. The wrench of claim 7 wherein said at least two gripping shells have multiple stages of gripping surfaces having multiple diameters.

15. The wrench of claim 7 wherein said cam driving surfaces of said drive shaft are substantially flat.

16. The wrench of claim 7 wherein said retainer comprises recessed portions adapted to engage lips formed on axial ends of said gripping shells.

17. The wrench of claim 7 further comprising a socket driver that is attached to said shaft and that is adapted to receive a ratchet wrench to apply torque from said ratchet wrench to said shaft.

18. The wrench of claim 7 further comprising a socket driver that is attached to said shaft and that is adapted to receive a powered rotational device to apply torque from said powered rotational device to said shaft.

19. The wrench of claim 18 wherein said powered rotational device is an air ratchet.

20. The wrench of claim 18 wherein said powered rotational device is a power drill.

21. The wrench of claim 7 wherein the said cam surfaces are adapted to turn said pipe in a single direction.

22. The wrench of claim 7 further comprising a collar connected to said coupler that forms a cylindrical opening between said gripping shells and an interior cylindrical surface of said collar that is adapted to receive said pipe and provide structural support for said pipe to prevent ovaling of said pipe.

23. A method of fabricating a wrench that is adapted to engage the internal surface of a pipe to turn said pipe comprising:

providing a shaft adapted to receive a torque to turn said pipe around a center axis of said shaft, said shaft having at least two cam surfaces that are adapted to transmit torque applied to said shaft;

providing at least two gripping shells each having at least one external gripping surface and at least one internal cam follower surface, said external gripping surface having a convex cylindrical shape that slidingly engages said concave cylindrically shaped internal surface of said pipe, and said internal cam follower surface being adapted to engage at least one of said cam driving surfaces on said drive shaft so that torque applied to said shaft is substantially symmetrically transmitted to said at least two gripping shells from said shaft in a direction that is substantially transverse to said center axis so that said gripping shells apply force to said concave cylindrically shaped internal surface of said pipe and said center axis is substantially aligned with a center axis of said pipe; and providing a retainer that engages said gripping shells to retain said gripping shells on said wrench adjacent said shaft and allows said shells to move freely, without being biased in said substantially transverse direction so that said shells automatically open and engage said internal surface of said pipe.

24. A method of turning a pipe with an internal pipe wrench comprising:

gripping a concave cylindrical internal surface of said pipe with one or more gripping shells of said internal pipe wrench, said gripping shells having convex gripping surfaces that are cylindrically shaped to slidingly engage said concave cylindrical internal surface of said pipe, said gripping shells further including cam follower surfaces that are adapted to be engaged by cam driver surfaces of a cam driver that apply torque to said cam follower surfaces causing said gripping shells to expand and engage said internal surface of said pipe so that said pipe is substantially aligned with said center axis, said gripping shells retained on said internal pipe wrench with a retainer that allows said gripping shells to move freely, without being biased so that said gripping shells automatically open and engage said concave cylindrical internal surface of said pipe whenever torque is applied to said cam driver;

applying a torque in either direction to said cam driver to cause said gripping shells to expand and engage said cam follower surface of said gripping shells; and turning said pipe in said direction of said torque.

25. A coupler that is adapted to engage a cylindrical concave internal surface of a cylindrical opening of a torque receptor comprising:

a shaft that rotates around a center axis, said shaft having at least two cam driving surfaces that are spaced substantially equally from said center axis and that are adapted to transmit torque applied to said shaft;

at least two gripping shells having axial end portions and convex external gripping surfaces that have a cylindrical convex profile and that slidingly engage said cylindrical concave internal surface, said gripping shells further including internal cam follower surfaces that are adapted to be engaged by said cam driving surfaces so that torque applied to said shaft is transmitted from said cam driving surfaces to said internal cam follower surfaces so that said center axis of said shaft is substantially aligned with a center axis of said cylindrical opening;

retaining recesses that axially and radially retain said gripping shells on said coupler adjacent said shaft and that allow said gripping shells to move freely in a radial direction and that allow said gripping shells to automatically engage said cylindrical concave internal surface of said cylindrical opening; and a driver connected to said shaft, said driver having a cylindrical collar portion that is substantially aligned with said center axis, said cylindrical collar portion having an interior cylindrical surface that is adapted to receive said torque receptor and provide structural support for said torque receptor to prevent ovaling and structural failure of said torque receptor.

26. A wrench for engaging an internal surface of a pipe and turning said pipe in either direction comprising:

a shaft that rotates around a center axis, said shaft having at least two cam driving surfaces that are spaced substantially equally from said center axis for transmitting torque applied to said shaft;

at least two gripping shells having external convex gripping surfaces that are cylindrically shaped, said external convex gripping surfaces disposed on said gripping shells to slidingly engage said cylindrically shaped concave internal surface of said pipe, said gripping shells further including internal cam follower surfaces that are designed to be engaged by at least two cam driving surfaces on said shaft so that said torque applied to said shaft is transmitted to said at least two gripping shells from said center axis in a direction that is substantially transverse to said center axis so that said gripping shells apply force to said cylindrically shaped concave internal surface of said pipe and said center axis of said shaft is substantially aligned with a center axis of said pipe;

a retainer that engages said gripping shells to retain said gripping shells on said wrench adjacent said shaft and allows said shells to freely move, without being biased, in a direction that is transverse to said center axis to automatically open and engage said internal surface of said pipe; and a driver connected to said shaft, said driver having a cylindrical collar portion that is substantially aligned with said center axis, said cylindrical collar portion having an interior cylindrical surface that is adapted to receive said pipe and provide structural support for said pipe to prevent ovaling and structural failure of said pipe.

* * * * *